US010994877B2

(12) United States Patent
Schiebout

(10) Patent No.: US 10,994,877 B2
(45) Date of Patent: May 4, 2021

(54) WEB PROCESSING WITH AT LEAST ONE SEMI-ROTARY ACCUMULATOR

(71) Applicant: Delta Industrial Services, Inc., Minneapolis, MN (US)

(72) Inventor: David Schiebout, Brainerd, MN (US)

(73) Assignee: Delta Industrial Services, Inc., Ramsey, MN (US)

( * ) Notice: Subject to any disclaimer, the term of this patent is extended or adjusted under 35 U.S.C. 154(b) by 0 days.

(21) Appl. No.: 16/752,081

(22) Filed: Jan. 24, 2020

(65) Prior Publication Data

US 2020/0156814 A1 May 21, 2020

Related U.S. Application Data

(63) Continuation of application No. 15/991,946, filed on May 29, 2018, now Pat. No. 10,583,946, which is a continuation of application No. 15/847,144, filed on Dec. 19, 2017, now Pat. No. 10,011,378, which is a continuation-in-part of application No. 15/817,859, filed on Nov. 20, 2017, now abandoned, which is a continuation of application No. 14/951,889, filed on Nov. 25, 2015, now Pat. No. 9,821,924, which is a (Continued)

(51) Int. Cl.

| | |
|---|---|
| ***B65G 13/04*** | (2006.01) |
| ***B65G 13/02*** | (2006.01) |
| ***B65B 41/16*** | (2006.01) |
| ***B65G 15/30*** | (2006.01) |
| ***B65H 1/00*** | (2006.01) |
| ***B65H 20/34*** | (2006.01) |
| ***B65H 23/188*** | (2006.01) |

(52) U.S. Cl.

CPC ..... *B65B 41/16* (2013.01); *B65H 1/00* (2013.01); *B65H 20/34* (2013.01); *B65H 23/1886* (2013.01); *B65H 2403/20* (2013.01); *B65H 2511/112* (2013.01)

(58) Field of Classification Search

None

See application file for complete search history.

(56) References Cited

U.S. PATENT DOCUMENTS

| | | | |
|---|---|---|---|
| 2,979,557 | A | 4/1961 | Schroeder |
| 3,734,265 | A | 5/1973 | Mueller |
| 3,850,213 | A | 11/1974 | Keaton |

(Continued)

OTHER PUBLICATIONS

U.S. Appl. No. 14/033,019 U.S. Pat. No. 9,216,866, filed Sep. 30, 2013, Web Processing With Semi-Rotary Accumulator.

(Continued)

*Primary Examiner* — Kavel Singh

(74) *Attorney, Agent, or Firm* — Schwegman Lundberg & Woessner, P.A.

(57) ABSTRACT

Various apparatus embodiments include first, second, third and fourth shafts, and further include a first movable shaft having a first movable axis that is movable between a first axis position and a second axis position, and a second movable shaft having a second movable axis that is movable between a third axis position and fourth axis position. At least one linkage connects the first movable shaft to the second movable shaft. A motor linkage connects the at least one linkage to at least one motor for providing simultaneous movement of the first and second movable shafts.

20 Claims, 31 Drawing Sheets

Related U.S. Application Data continuation of application No. 14/033,019, filed on Sep. 20, 2013, now Pat. No. 9,216,866.

(56) References Cited

U.S. PATENT DOCUMENTS

| | | | | |
|---|---|---|---|---|
| 3,902,376 | A | 9/1975 | Humphrey | |
| 4,093,140 | A * | 6/1978 | Matsunaga | B65H 18/103 242/529 |
| 4,174,104 | A | 11/1979 | Garvey | |
| 5,127,981 | A | 7/1992 | Straub et al. | |
| 5,190,234 | A * | 3/1993 | Ezekiel | B65H 19/14 156/157 |
| 5,281,030 | A | 1/1994 | Krnac | |
| 6,772,873 | B1 | 8/2004 | Coleman | |
| 7,905,443 | B2 * | 3/2011 | Papania | B21C 49/00 242/525.6 |
| 8,436,272 | B2 | 5/2013 | David | |
| 9,216,866 | B2 | 12/2015 | Schiebout | |
| 9,387,131 | B2 * | 7/2016 | Andrews | A61F 13/15772 |
| 9,821,924 | B2 | 11/2017 | Schiebout | |
| 10,011,378 | B2 | 7/2018 | Schiebout et al. | |
| 2003/0052148 | A1 * | 3/2003 | Rajala | B65H 23/063 226/44 |
| 2009/0020211 | A1 | 1/2009 | Andrews et al. | |
| 2011/0139586 | A1 | 6/2011 | Lin et al. | |
| 2015/0083551 | A1 | 3/2015 | Schiebout | |
| 2016/0083128 | A1 | 3/2016 | Schiebout | |
| 2018/0105303 | A1 | 4/2018 | Schiebout | |
| 2019/0023435 | A1 | 1/2019 | Schiebout | |

OTHER PUBLICATIONS

U.S. Appl. No. 14/951,889 U.S. Pat. No. 9,821,924, filed Nov. 25, 2015, Web Processing With Semi-Rotary Accumulator.
U.S. Appl. No. 15/817,859, filed Nov. 20, 2017, Web Processing With Semi-Rotary Accumulator.
U.S. Appl. No. 15/847,144 U.S. Pat. No. 10,011,378, filed Dec. 19, 2017, Web Processing With Semi-Rotary Accumulator.
U.S. Appl. No. 15/991,946, filed May 29, 2018, Web Processing With at Least One Semi-Rotary Accumulator.
"U.S. Appl. No. 14/033,109, Non Final Office Action dated Apr. 28, 2015", 10 pgs.
"U.S. Appl. No. 14/033,019, Notice of Allowance dated Aug. 18, 2015", 6 pgs.
"U.S. Appl. No. 14/033,019, filed Jul. 28, 2014 to Non Final Office Action dated Apr. 28, 2015", 14 pgs.
"U.S. Appl. No. 14/951,889, Advisory Action dated Sep. 21, 2016", 3 pgs.
"U.S. Appl. No. 14/951,889, Final Office Action dated Jun. 23, 2017", 7 pgs.
"U.S. Appl. No. 14/951,889, Final Office Action dated Jul. 6, 2016", 9 pgs.
"U.S. Appl. No. 14/951,889, Non Final Office Action dated Feb. 5, 2016", 8 pgs.
"U.S. Appl. No. 14/951,889, Non Final Office Action dated Feb. 28, 2017", 7 pgs.
"U.S. Appl. No. 14/951,889, Non Final Office Action dated Dec. 21, 2015", 6 pgs.
"U.S. Appl. No. 14/951,889, Notice of Allowance dated Jul. 24, 2017", 6 pgs.
"U.S. Appl. No. 14/951,889, Preliminary Amendment dated Dec. 18, 2015", 7 pgs.
"U.S. Appl. No. 14/951,889, filed May 5, 2016 to Non Final Office Action dated feb. 5, 2016", 11 pgs.
"U.S. Appl. No. 14/951,889, filed May 30, 2017 to Non Final Office Action dated Feb. 28, 2017", 10 pgs.
"U.S. Appl. No. 14/951,889, filed Jul. 11, 2017 to Final Office Action dated Jun. 23, 2017", 9 pgs.
"U.S. Appl. No. 14/951,889, filed Sep. 12, 2016 to Frinal Office Action dated Jul. 6, 2016", 9 pgs.
"U.S. Appl. No. 15/847,144, 312 Amendment filed May 23, 2018", 8 pgs.
"U.S. Appl. No. 15/847,144, Notice of Allowance dated Feb. 28, 2018", 8 pgs.
"U.S. Appl. No. 15/847,144, PTO Response to Rule 312 Communication mailed May 31, 2018", 2 pgs.
"U.S. Appl. No. 15/991,946, Non Final Office Action dated Apr. 22, 2019", 11 pgs.
"U.S. Appl. No. 15/991,946, Notice of Allowance dated Oct. 22, 2019", 8 pgs.
"U.S. Appl. No. 15/991,946, Preliminary Amendment filed Oct. 16, 2018", 7 pgs.
"U.S. Appl. No. 15/991,946, filed Sep. 20, 2019 to Non Final Office Action dated Apr. 22, 2019", 9 pgs.

* cited by examiner

| | |
|---|---|
| PRE ACCUMULATOR LENGTH | 1.75 IN. |
| POST ACCUMULATOR LENGTH | 2.625 IN. |
| MATCH LENGTH | 1.5 IN. |

| START | ACCEL | MATCH LENGTH | DECEL | ACCEL | DECEL |
|---|---|---|---|---|---|
| 0 | 0.0937 | 1.5937 | 1.6874 | 2.1559 | 2.1559 MASTER POSITION (IN.) |
| 0 | 0.166666667 | 0.166666667 | 0 | -0.566666667 | 0 GEAR RATION |

WEB PROCESSING WITH AT LEAST ONE SEMI-ROTARY ACCUMULATOR

PRIORITY

This application is a continuation of U.S. patent application Ser. No. 15/991,946, filed May 29, 2018, which is a continuation of U.S. patent application Ser. No. 15/847,144, filed Dec. 19, 2017, now issued as U.S. Pat. No. 10,011,378, which is a Continuation-in-Part of U.S. patent application Ser. No. 15/817,859, filed Nov. 20, 2017, which application is a Continuation of U.S. patent application Ser. No. 14/951,889, filed Nov. 25, 2015, now issued as U.S. Pat. No. 9,821,924, which application is a Continuation of U.S. patent application Ser. No. 14/033,019, filed Sep. 20, 2013, now issued as U.S. Pat. No. 9,216,866; which applications are incorporated herein by reference in their entirety.

TECHNICAL FIELD

This application relates generally to automated systems and methods for producing product, and more particularly to automated web processing systems such as web converting and packaging systems.

BACKGROUND

There are various automated systems and methods for producing product. By way of example, automated web converting systems may process material from different rolls of material to form product. The continuous rolls of material are fed as "webs" through web processing components to form a new product that may be an intermediate or final product. Converting processes may include coating, laminating, printing, die cutting, slitting, and the like.

A design goal for these automated systems may be to reduce material waste while maintaining a fast, accurate process. Thus, parts may be closely spaced in one web to reduce waste in the web, but may be required to be further spaced apart on a second web for further processing steps. An example of a system of providing such placement is a pick-and-place apparatus or an island placement apparatus. An example of an island placement apparatus is provided in U.S. Pat. Nos. 7,293,593 and 8,097,110, both entitled "Island Placement Technology."

SUMMARY

Various embodiments provided herein provide an apparatus for processing web that uses a semi-rotary accumulator to change web speed for transferring parts from a first web onto a second web. For example, a first web may run at a first speed entering a first web path through the semi-rotary accumulator. Operation of the semi-rotary accumulator may cause the web speed exiting the first web path within the accumulator to intermittently speed up and slow down. This variable speed web enters a second web path through the semi-rotary accumulator. Operation of the semi-rotary accumulator may transition the variable speed web motion entering the second web path back the first speed when exiting the second web path. A programmed cam motion profile may be used to control timing of the accumulator motion to provide a desired part placement on a second moving web.

An apparatus embodiment may comprise a first idler shaft, a second idler shaft, a third idler shaft, and a fourth idler shaft. The apparatus may further comprise a first movable idler shaft having a first movable axis that is movable between a first axis position and a second axis position, and a second movable idler shaft having a second movable axis that is movable between a third axis position and fourth axis position. At least one linkage connects the first movable idler shaft to the second movable idler shaft. A motor linkage is configured to connect the at least one linkage to at least one motor for providing simultaneous movement of the first and second movable idler shafts. Simultaneous movement of the first movable idler shaft toward the first axis position and the second movable idler shaft toward the third axis position increases a length of the first web path between the first and second idler shafts and decreases a length of the second web path between the third and fourth idler shafts. Simultaneous movement of the first movable idler shaft toward the second axis position and the second movable idler shaft toward the fourth axis position decreases the length of the first web path between the first and second idler shafts and increases the length of the second web path between the third and fourth idler shafts.

An apparatus embodiment may comprise first and second end supports, and first, second, third and fourth idler shafts extending between the first and second end supports. The first idler shaft may be configured to rotate about a first axis in a first fixed position, the second idler shaft may be configured to rotate about a second axis in a second fixed position, the third idler shaft may be configured to rotate about a third axis in a third fixed position, and the fourth idler shaft may be configured to rotate about a fourth axis in a fourth fixed position. The apparatus may further comprise first and second movable idler shafts extending between the first and second end supports, where the first movable idler shaft may be configured to rotate about a first movable axis that is movable between a first axis position and a second axis position, and the second movable idler shaft may be configured to rotate about a second movable axis that is movable between a third axis position and fourth axis position. A first web path length between the first idler shaft and the second idler shaft is longest when the first movable idler shaft is in the first axis position and shortest when the first movable idler shaft is in the second axis position. A second web path length between the third idler shaft and the fourth idler shaft is shortest when the second movable idler shaft is in the third axis position and longest when the second movable idler shaft is in the fourth axis position. A first linkage connects a first side of the first movable idler shaft to a first side of the second movable idler shaft, and a second linkage connects a second side of the second movable idler shaft to a second side of the second movable idler shaft. A motor linkage is configured to connect the first and second linkages to a motor to allow the motor to simultaneously move the first and second movable idler shafts in a first direction, and to simultaneously move the first and second movable idler shafts in a second direction opposite the first direction. The motor linkage may include a drive shaft extending between the first and second end supports where the drive shaft including a first drive shaft pulley proximate the first end support and a second drive shaft pulley proximate the second end support. A first belt is around the first drive shaft pulley and another pulley proximate the first end support. A second belt is around the second drive shaft pulley and another pulley proximate the second end support. A first linear bearing rail is mounted to the first end support. A cooperating first linear bearing block assembly is configured to linearly move along the first linear bearing rail and to connect the first belt to the first linkage. A second linear bearing rail is mounted to the second end support. A cooperating second linear bearing block assembly is configured to linearly move along the second linear bearing rail and to connect the second belt to the second linkage.

A method embodiment may comprise passing a web through a first web path within an apparatus in a first direction to a station, and passing the web from the station through a second web path within the apparatus in a second direction. Passing the web through the first web path may include passing the web past a first idler shaft with a first axis in a first fixed position, a first movable idler shaft with a first movable axis configured to be movable between a first axis position and a second axis position, and a second idler shaft with a second axis in a second fixed position. Passing the web from the station through the second web path may include passing the web past a third idler shaft with a third axis in a third fixed position, a second movable idler shaft with a second movable axis configured to be movable between a third axis position and a fourth axis position, and a fourth idler shaft with a fourth axis in a fourth fixed position. The method embodiment may intermittently decrease and increase speed of the web at the part transfer station, which may include simultaneously moving the first movable idler shaft toward the first axis position and the second movable idler shaft toward the third axis position to decrease speed of the web at the transfer station, and simultaneously moving the first movable idler shaft toward the second axis position and the second movable idler shaft toward the fourth axis position to increase speed of the web at the transfer station.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

Figure 6:
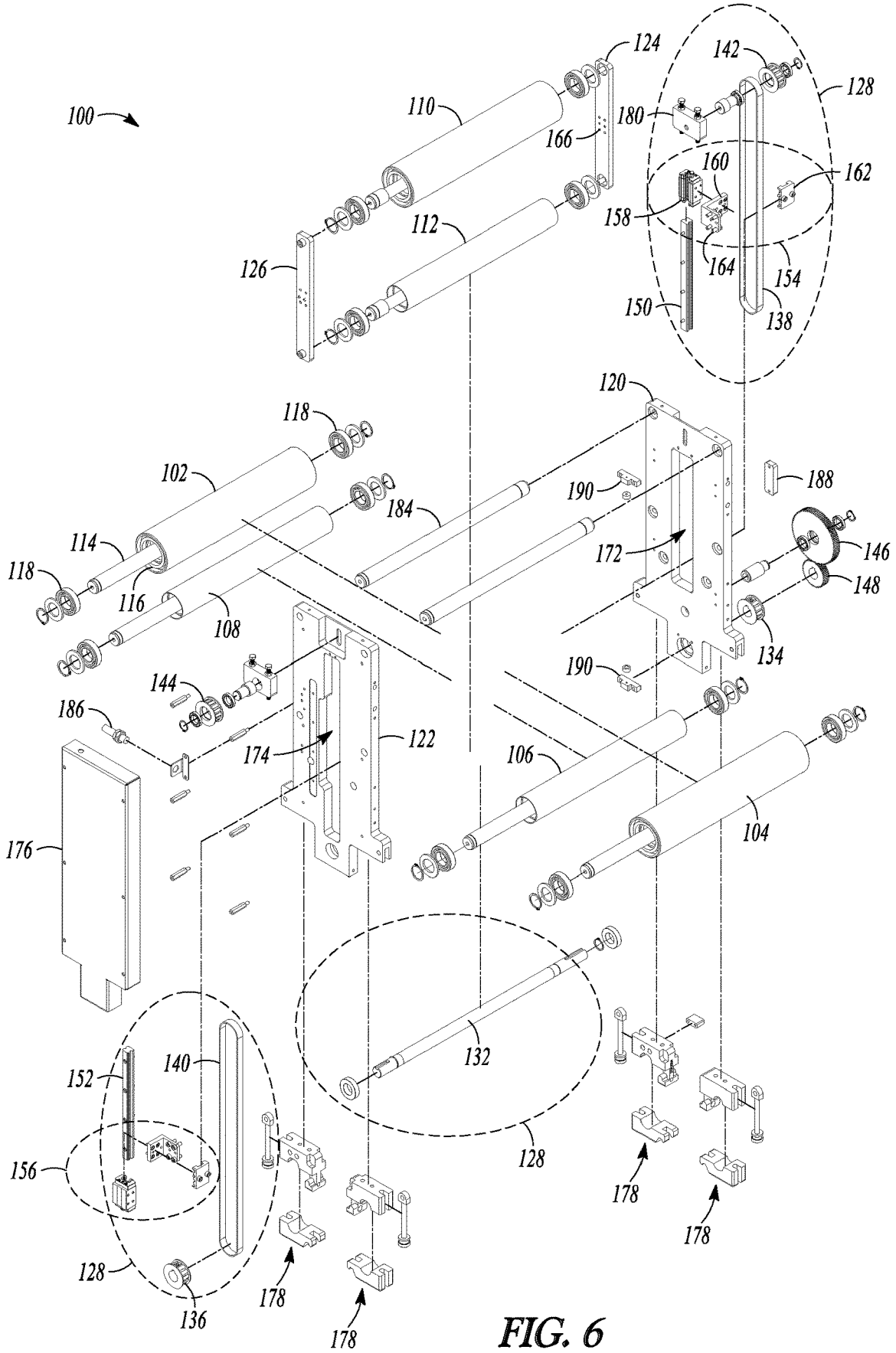
FIG. 6 illustrates an exploded view of the accumulator illustrated in FIG. 5.
Figure 7C:
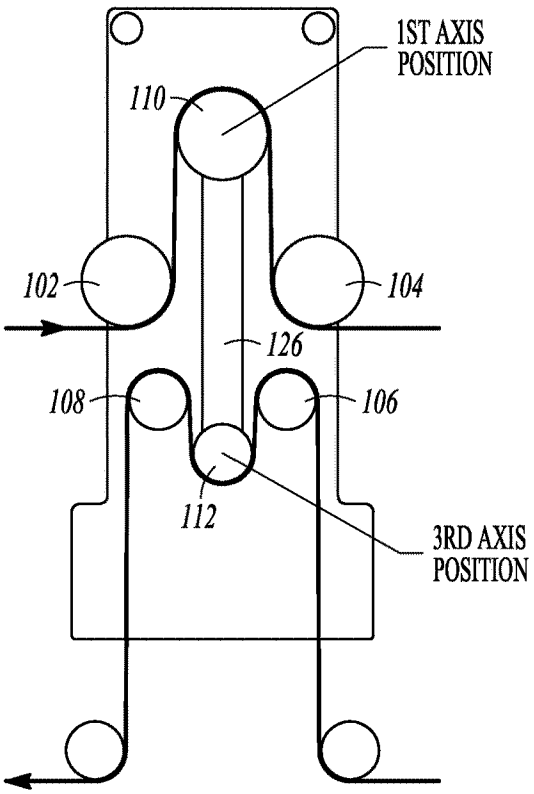
FIGS. 7A-7C illustrate web paths through the embodiment of the semi-rotary accumulator illustrated in FIG. 1 and further illustrate motion of the movable idlers shafts within the semi-rotary accumulator.
Figure 7B:
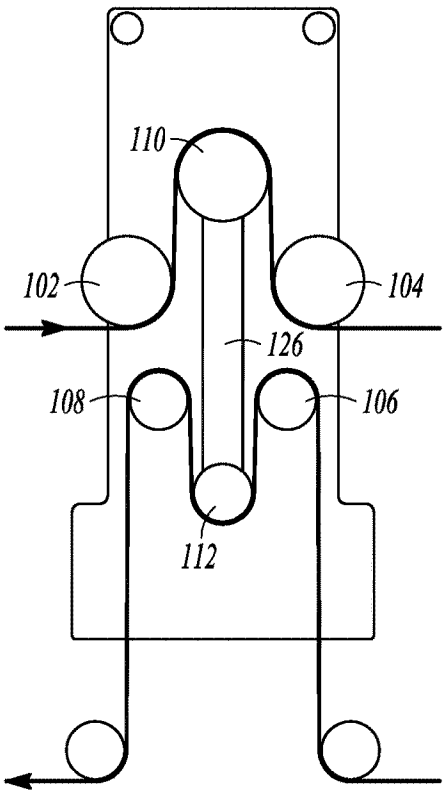
Figure 7A:
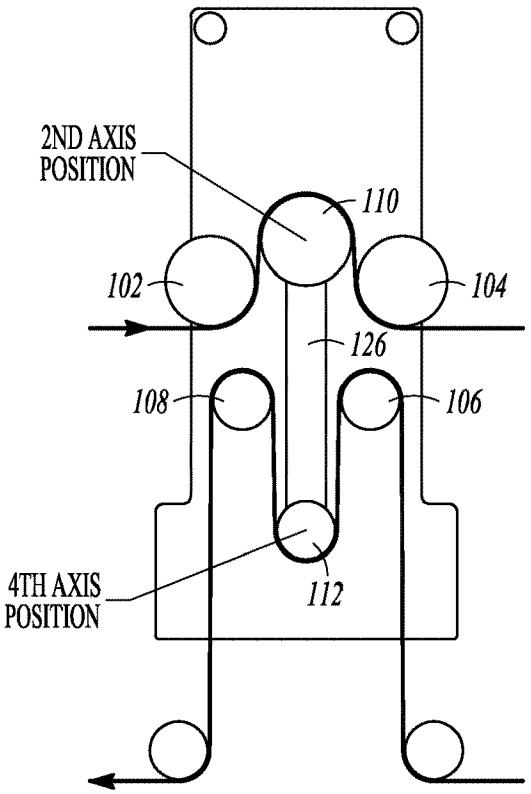

FIGS. 1-6 illustrate various views of an embodiment of a semi-rotary accumulator. The illustrated accumulator 100 includes a first idler shaft 102, a second idler shaft 104, a third idler shaft 106, and a fourth idler shaft 108. The apparatus 100 further includes a first movable idler shaft 110 shaft having a first movable axis that is movable between a first axis position and a second axis position, and a second movable idler shaft 112 having a second movable axis that is movable between a third axis position and fourth axis position, as is generally illustrated in FIGS. 7A-7C. Each of the idler shafts 102, 104, 106, 108, 110 and 112 has an axis along its shaft. Each of these idler shafts may be configured to freely rotate when a web passes by and in contact with the idler shaft. That is, the idler shafts do not rotate under their own power, but may easily rotate as the web passes through the web paths of the accumulator. Other mechanism may be used to change directions of the web. For example, some embodiments may use an air bar to change direction of the web. For example, the illustrated idler shafts may have a center shaft 114, a cylindrical roll 116, and bearings 118 (illustrated as an example in FIG. 6 with respect to the first idler shaft 102) to allow the cylindrical roll to rotate around the center shaft. FIG. 6 also illustrates various hardware components for assembling the accumulator such as retaining rings, screws, bolts and washers and nuts, as will be understood by those of ordinary skill in the art. The idler shafts are illustrated as spanning or extending between a first and second end support 120 and 122. It is understood that, in addition to extending between the first and second end supports, the idler shafts may further extend past the first and/or second end support. Each of the first and second end supports may be configured with a plate-like structure and thus may be referred to as end plates. The first and second end supports will be described in more detail below. Some embodiments may use a cantilever design, and such cantilever embodiments may only use a single end support.

The illustrated accumulator 100 further includes a first linkage 124 connecting a first side of the first movable idler shaft 110 to a first side of the second movable idler shaft 112, and a second linkage 126 connecting a second side of the first movable idler shaft 110 to a second side of the second movable idler shaft 112. The first and second linkages 124 and 126 function to maintain a fixed distance between the first and second movable idler shafts 110 and 112, and also function to maintain a parallel orientation of the first and second movable idler shafts 110 and 112 with respect to each other. The illustrated first and second linkages 124 and 126 between the first and second movable idler shafts 110 and 112 are mechanical linkages. Those of ordinary skill in the art will appreciate that the first and second movable idler shafts 110 and 112 may be electrically linked rather than mechanically linked. For example, each of the first and second movable idler shafts 110 and 112 may be controlled by its own motor, and each of these motors may be controlled to move the first and second movable idler shafts 110 and 112 together to maintain a fixed distance between them. The use of a linkage on each side of the movable idler shafts limits deflection in the idler shafts. However, some embodiments may implement a single linkage between the movable idler shafts 110 and 112.

Figure 12C:
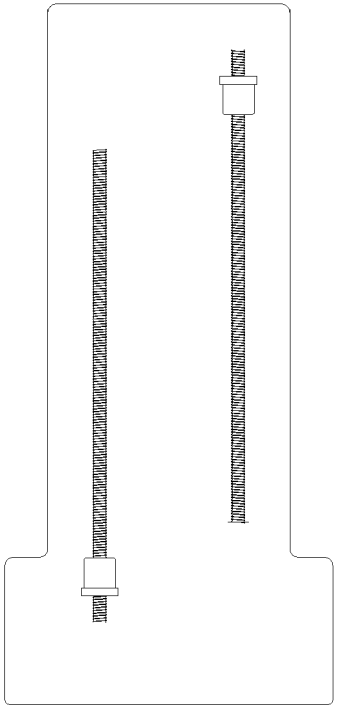
FIGS. 12A-12C illustrate examples of different drive mechanisms to drive the movable idlers shafts in the semi-rotary accumulator.
Figure 12B:
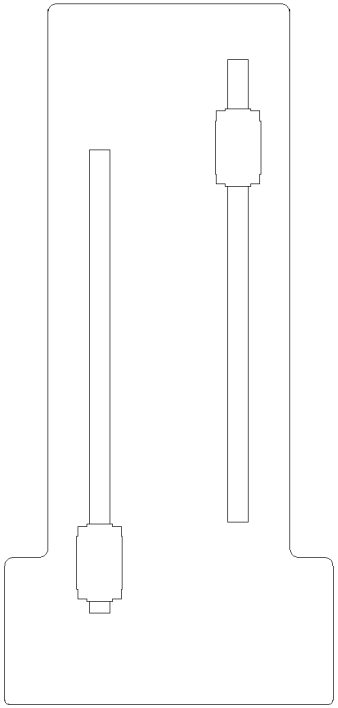
Figure 12A:
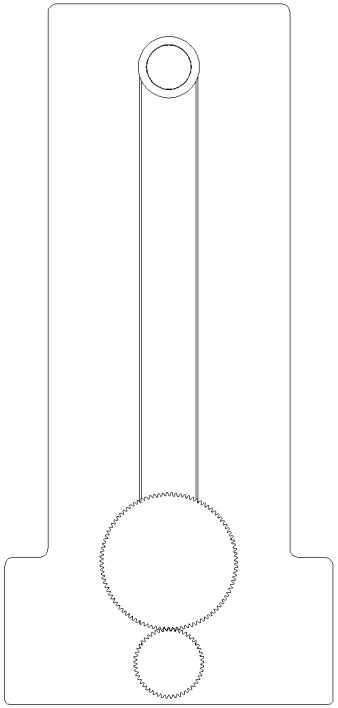

The illustrated accumulator 100 further includes a motor linkage 128 illustrated generally in the exploded view of FIG. 6 configured to connect the first and second linkages 124 and 126 to a motor for providing simultaneous movement of the first and second movable idler shafts 110 and 112. The illustrated motor linkage 128 that has a drive shaft 132 including a first drive shaft pulley 134 proximate the first end support 120 and a second drive shaft pulley 136 proximate the second end support 122, a first belt 138 and a second belt 140. The first belt 138 is around the first drive shaft pulley 134 and a first stub pulley 142, and is connected to the first linkage 124. The second belt 138 is around the second drive shaft pulley 136 and a second stub pulley 144, and is connected to the second linkage 126. Operation of the motor drives gears 146 and 148 to cause the drive shaft 132 to rotate, and rotation of the drive shaft 132 moves the first and second belts 138 and 140, the first and second linkages 124 and 126, and the first and second movable idler shafts 110 and 112. As will be understood by those of ordinary skill in the art upon reading and comprehending this disclosure, the movable idler shafts 110 and 112 may be moved using designs without belts. FIGS. 12A-12C illustrates examples of different drive mechanisms to drive the movable idlers shafts in the semi-rotary accumulator. For example, FIG. 12A illustrates an accumulator design that uses belts to drive the movable idler shafts 110 and 112, FIG. 12B illustrates an accumulator design that uses linear motors to drive the movable idler shafts 110 and 112, and FIG. 12C illustrates an accumulator design that uses ball screws to drive the movable idler shafts 110 and 112. Other examples of drive mechanisms that may be used to provide the motion of the movable idler shafts 110 and 112 include rack and pinion, mechanical cam and the like.

The illustrated accumulator 100 further includes a first and second linear bearing rails 150 and 152, and first and second linear bearing block assemblies 154 and 156. The first linear bearing rail 150 is mounted to the first end support 120 and the cooperating first linear bearing block assembly 154 is configured to linearly move along the first linear bearing rail 150. The first linear bearing block assembly 154 is configured to connect the first belt 138 to the first linkage 124. The second linear bearing rail 152 is mounted to the second end support 122 and the cooperating second linear bearing block assembly 156 is configured to linearly move along the second linear bearing rail 152. The second linear bearing block assembly 156 is configured to connect the second belt 140 to the second linkage 126. The illustrated linear bearing block assemblies include a linear bearing block 158 configured to ride on the linear bearing rail, and further includes a bracket 160 connected to the bearing block 158 and a clamp 162 configured to clamp the belt between the clamp 162 and the bracket 160. Furthermore, the linear bearing block assembly may be configured to extend into an opening in the side support to connect the linkage (e.g. 124 or 126). For example, the bracket 160 may be formed with pins 164 configured to fit in opening 166 within the linkage (e.g. 124) to cause the linkage to move with the belt.

The first end support 120 may include a first end plate with a first flat major surface 168, and the second end support 122 may include a second end plate with a second flat major surface 170 facing toward and substantially parallel with the first flat major surface. In the illustrated embodiment, each of the idler shafts is substantially perpendicular to the first and second flat major surfaces. Each of the first and second end plates includes an opening 172 and 174 configured to allow the bracket 160 to extend through the opening to connect with the linkages 124 and 126 and allow linear movement of the linkages 124 and 126 to simultaneously move the first movable idler shaft 110 and the second movable idler shaft 112 in the same direction.

The accumulator 100 may further include a front guard 176 configured to be attached to the second end support and cover the second belt and other moving parts proximate to the second end support. Additionally, the accumulator may include mounting clamps 178 for use to mount and clamp accumulator onto a web processing machine. For example, mounting rods may extend horizontally out from the web processing machine. The top portion of the mounting clamps may rest on the mounting rods, and the bottom portion may be clamped around the mounting rods to secure the accumulator in place. As illustrated, the accumulator 100 may also include belt tension adjustment blocks 180 to adjust tension in the drive belts. For example, threaded bolts 182 may be turned to screw into the block to increase tension in the belt, or may be turned to screw out of the block to decrease tension in the belt.

The accumulator may further include additional idlers on shaft 184 useful for providing desired web path into and out of the accumulator. Also, a sensor such as a proximity sensor 186 may be used to detect when the linear bearing block assembly is proximate to the sensor, for use in timing the motion of the first and second movable idler shafts 110 and 112. Other sensor(s) may be used to provide input for the larger web handling system. For example, a reflector 188 may be used to allow a sensor on the larger system to detect that the accumulator has been installed. Additionally, hard stops 190 may be used to limit motion under conditions such as a broken belt, a loss of motion profile, or an actuated emergency stop ("E-Stop").

Figure 1:
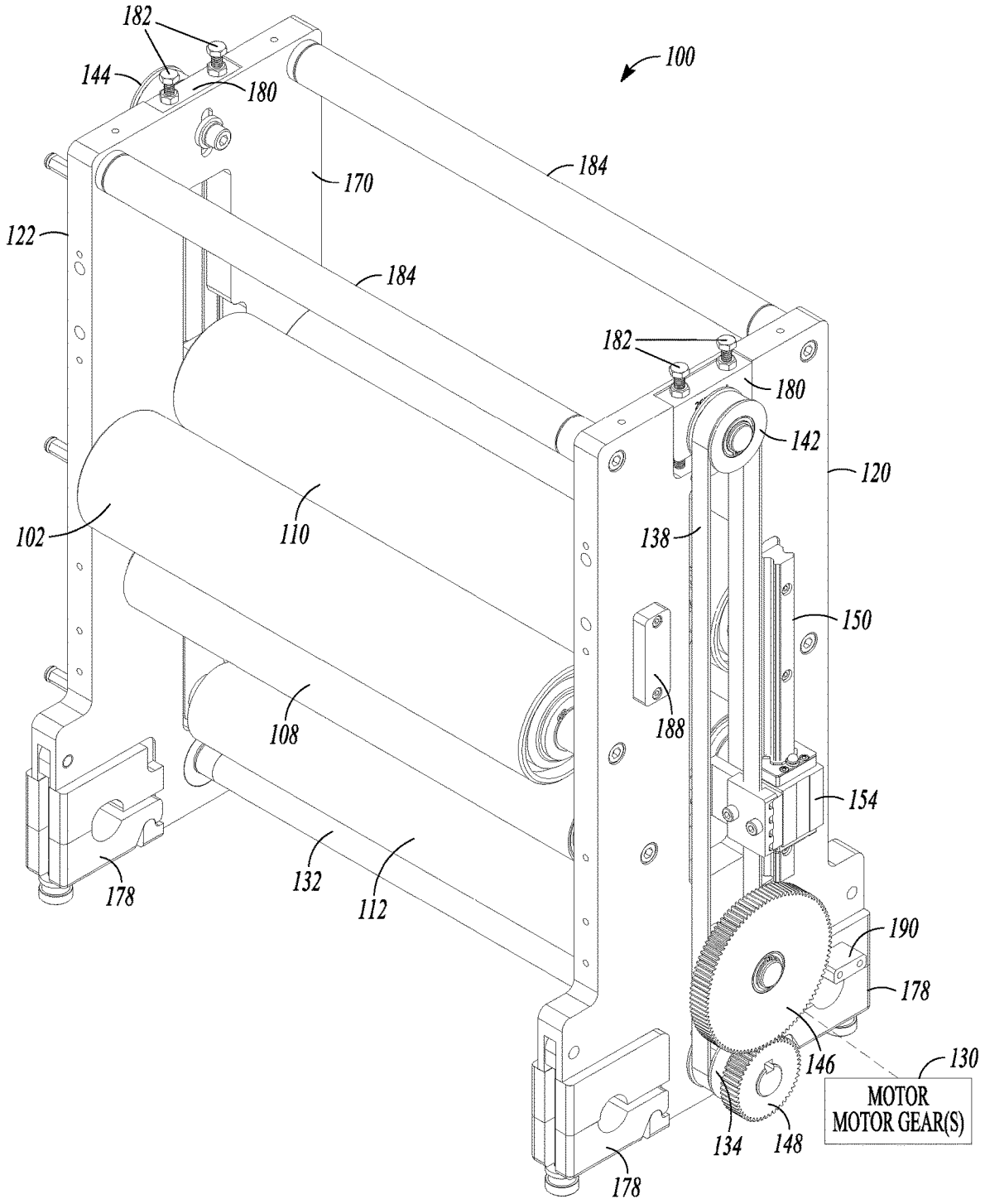
FIG. 1 illustrates a perspective rear view of an embodiment of a semi-rotary accumulator.
Figure 2:
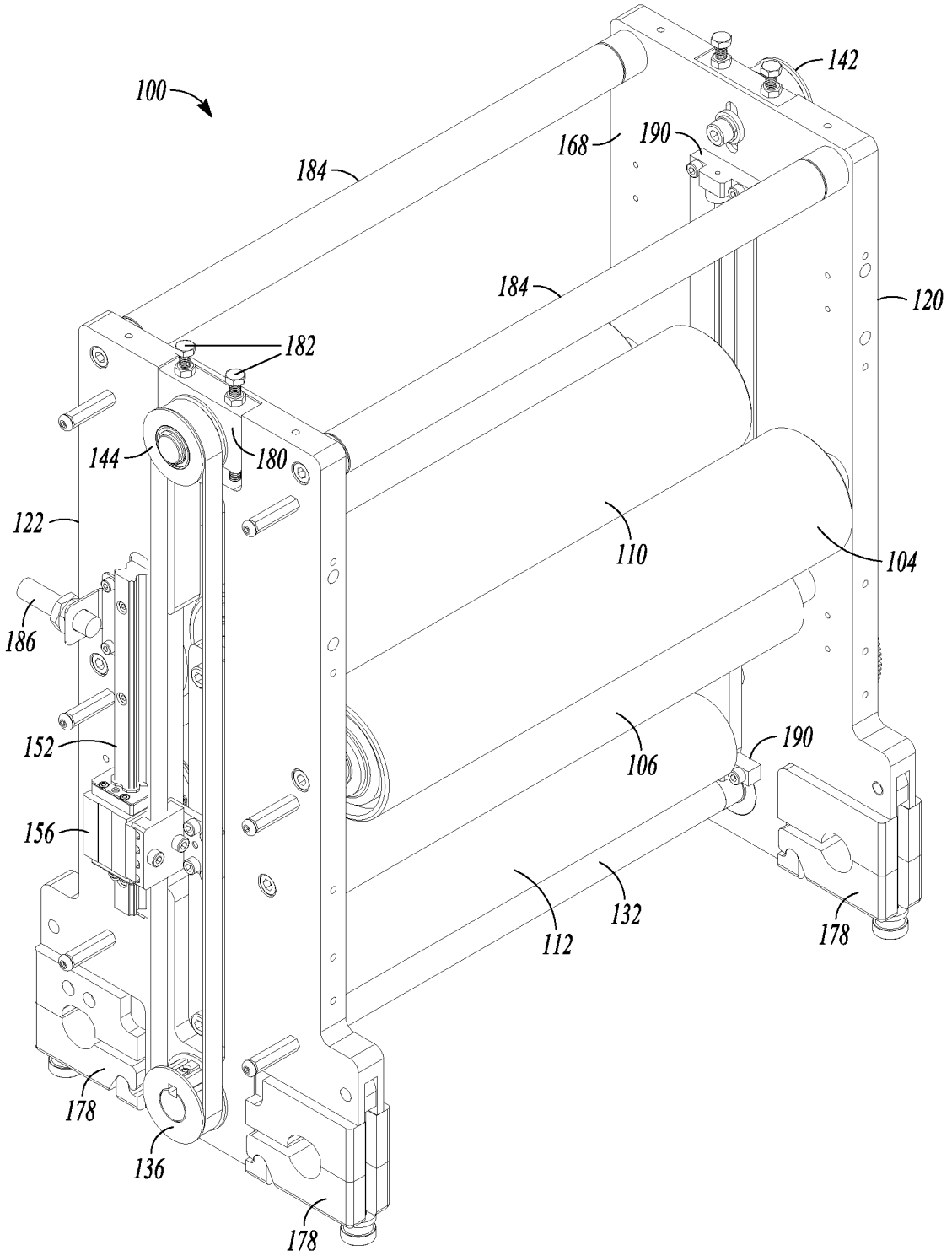
FIG. 2 illustrates a perspective front view of the embodiment of the accumulator illustrated in FIG. 1
Figure 4:
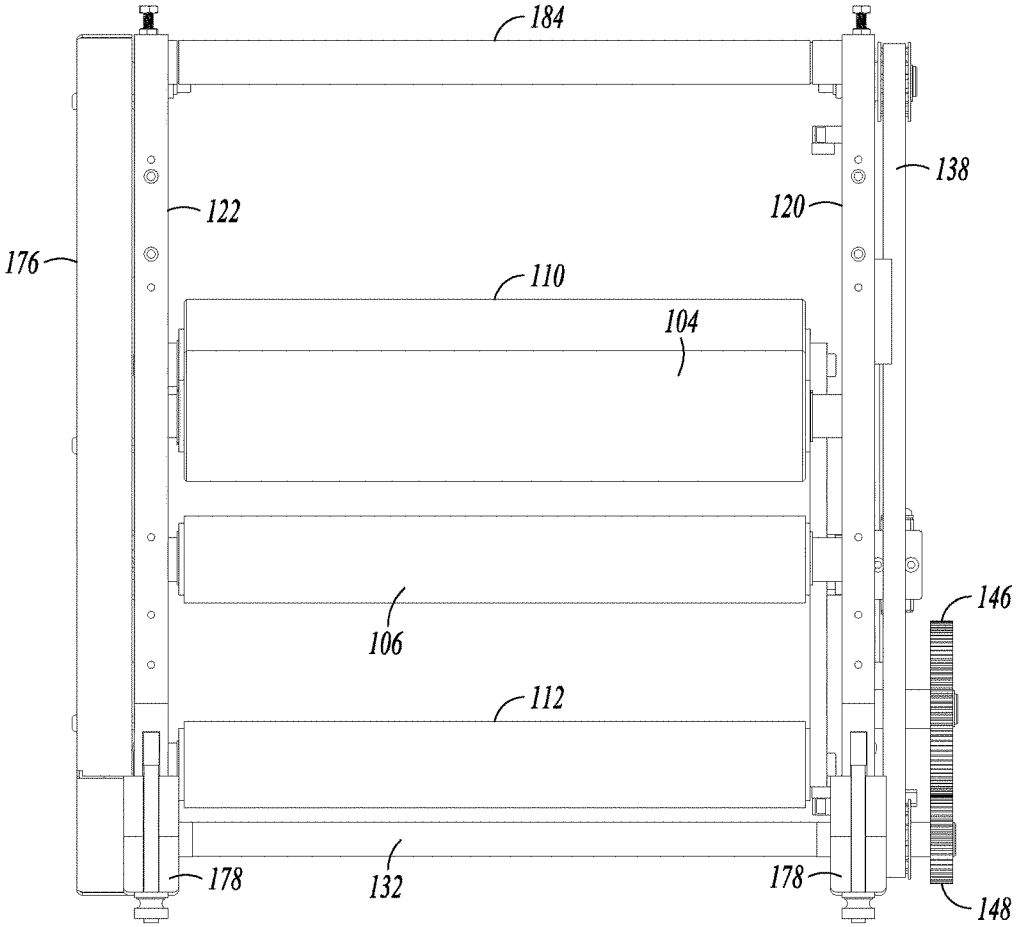
FIG. 4 illustrates a side planar view of the embodiment of the accumulator illustrated in FIG. 1 with an attached guard.
Figure 3:
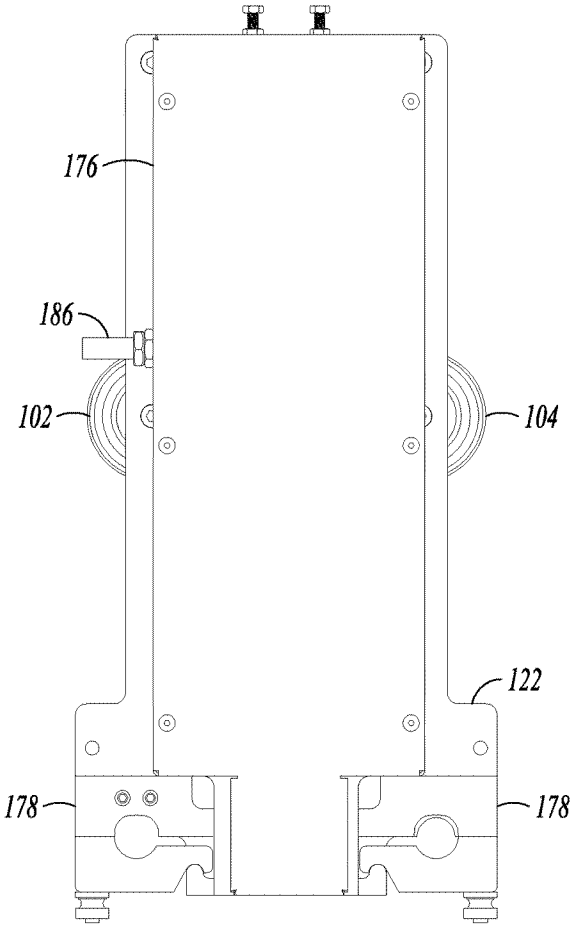
FIG. 3 illustrates a front planar view of the embodiment of the accumulator illustrated in FIG. 1 with an attached guard.
Figure 5:
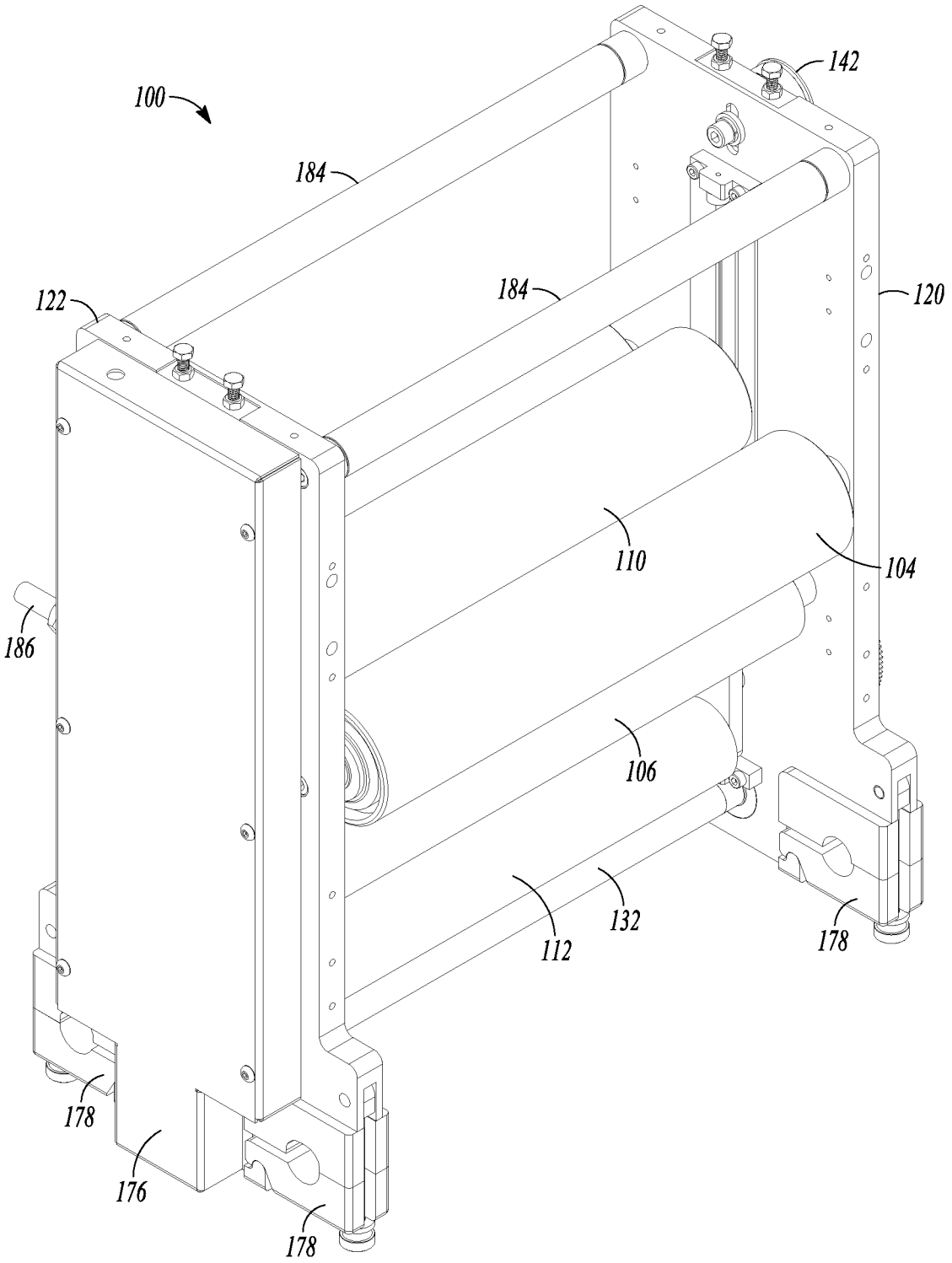
FIG. 5 illustrates the perspective front view of FIG. 2 with an attached guard.

FIGS. 7A-7C illustrate web paths through the embodiment of the semi-rotary accumulator illustrated in FIG. 1 and further illustrate motion of the movable idlers shafts within the semi-rotary accumulator. These figures illustrate a schematic side view of the accumulator to illustrate the relative positions of the first idler shaft 102, the second idler shaft 104, the third idler shaft 106, and the fourth idler shaft 108, and to further illustrate the motion of the first and second movable idler shafts 110 and 112. A first web path may travel from the first idler shaft 102 past the first movable idler shaft 110 and to the second idler shaft 104. A second web path may travel from the third idler shaft 106 past the second movable idler shaft 112 and to the fourth idler shaft 108. The first and second movable idler shafts 110 and 112 move together in concert as they are they are connected (e.g. second linkage 126 illustrated in FIGS. 7A-C). Simultaneous movement of the first movable idler shaft 110 toward the first axis position and the second movable idler shaft toward the third axis position (e.g. FIG. 7C) increases a length of the first web path between the first and second idler shafts 102 and 104 and decreases a length of the second web path between the third and fourth idler shafts 106 and 108. Simultaneously movement of the first movable idler shaft 110 toward the second axis position and the second movable idler shaft 112 toward the fourth axis position (e.g. FIG. 7A) decreases the length of the first web path between the first and second idler shafts 102 and 104, and increases the length of the second web path between the third and fourth idler shafts 106 and 108. The position of the axes are designed to cause the web length changes to be complementary. That is, the increase in the length of the first web path corresponds to the decrease in the length of the second web path, and the decrease in the length of the first web path corresponds to the increase in the length of the second web path. The idler shafts 102, 104, 106, 108 may have fixed axes to avoid introducing additional inertia into the web. However, a system may be designed to provide the complementary web length changes using non-fixed axes. Furthermore, the diameter of the idler shafts is not intended to limit the scope of the present subject matter. Larger diameter idler shafts, such as illustrated in use with the first web path, may be used when the web has product on it to avoid damaging the product or causing the product to release from the web, for example. In the second web path, for example, the web may no longer have the product, such that smaller idler shafts may be used.

Figure 8:
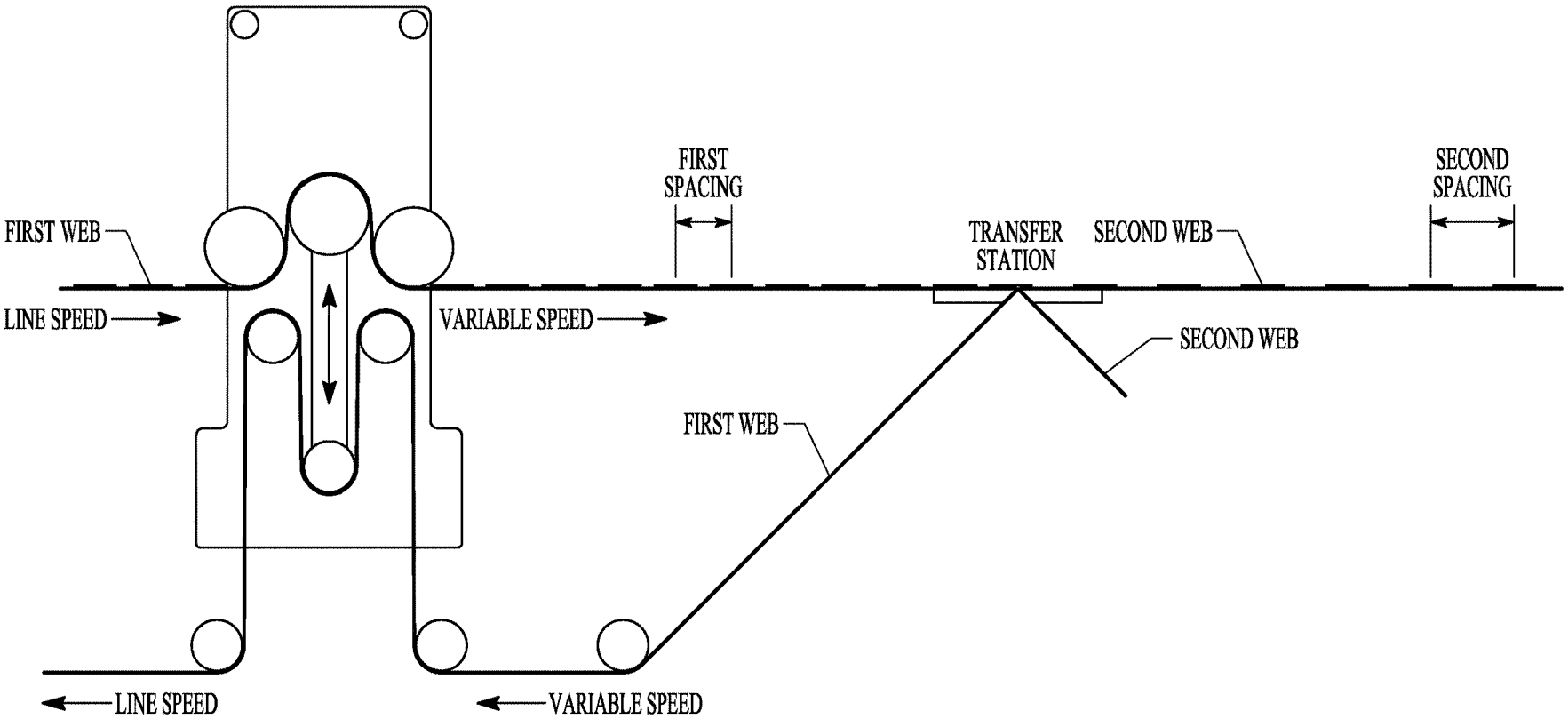
FIG. 8 illustrates the embodiment of a system that includes a semi-rotary accumulator with a part transfer station.

FIG. 8 illustrates the embodiment of a system that includes a semi-rotary accumulator with a part transfer station. The illustrated system includes a first web and a second web. Parts are transferred from the first web to the second web at the transfer station. For example, parts may be lightly adhered to the first web as it passes through the first web pass of the accumulator toward the transfer station. At the transfer station, the first web is pulled at a sharp angle, such that the parts detach from the first web and continue in a straight line onto the second web. The illustrated system may be used to change the spacing between parts. For example, the spacing between parts is closer on the first web than the spacing of parts on the second web.

The first web may enter the first web path of the accumulator at line speed, and exits the second web path of the accumulator at line speed. However, operation of the accumulator causes the speed of the web to vary at the transfer station. The speed of the first web may match the speed of the second web during the part transfer. However, in order to increase the spacing between parts on the second web, the first web may temporarily decrease in speed between part transfers, may temporarily stop between part transfers, and/or may temporarily reverse directions between part transfers.

Figure 9A:
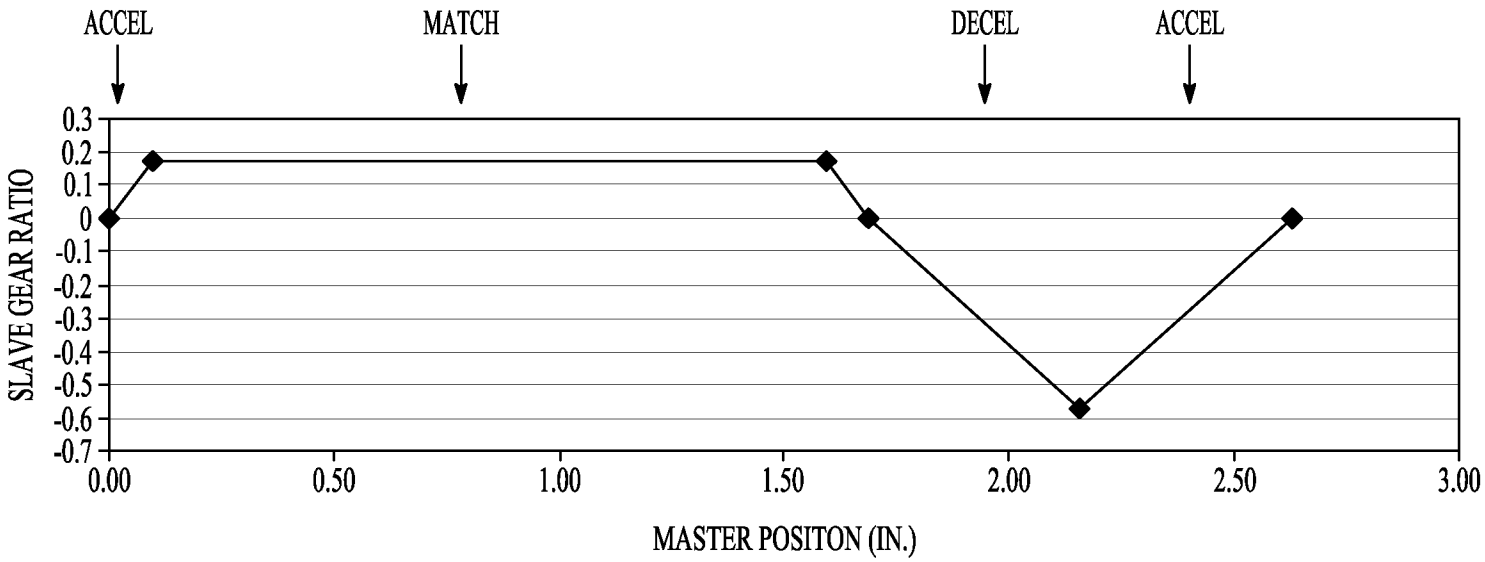
FIGS. 9A-9B illustrate an example of a Position CAM (PCAM) profile for controlling motion of the semi-rotary accumulator to place parts on the part transfer station illustrated in FIG. 8, where FIG. 9A plots a slave gear ratio against a master position in inches, and where FIG. 9B plots a slave position against a master position in motor counts.
Figure 9B:
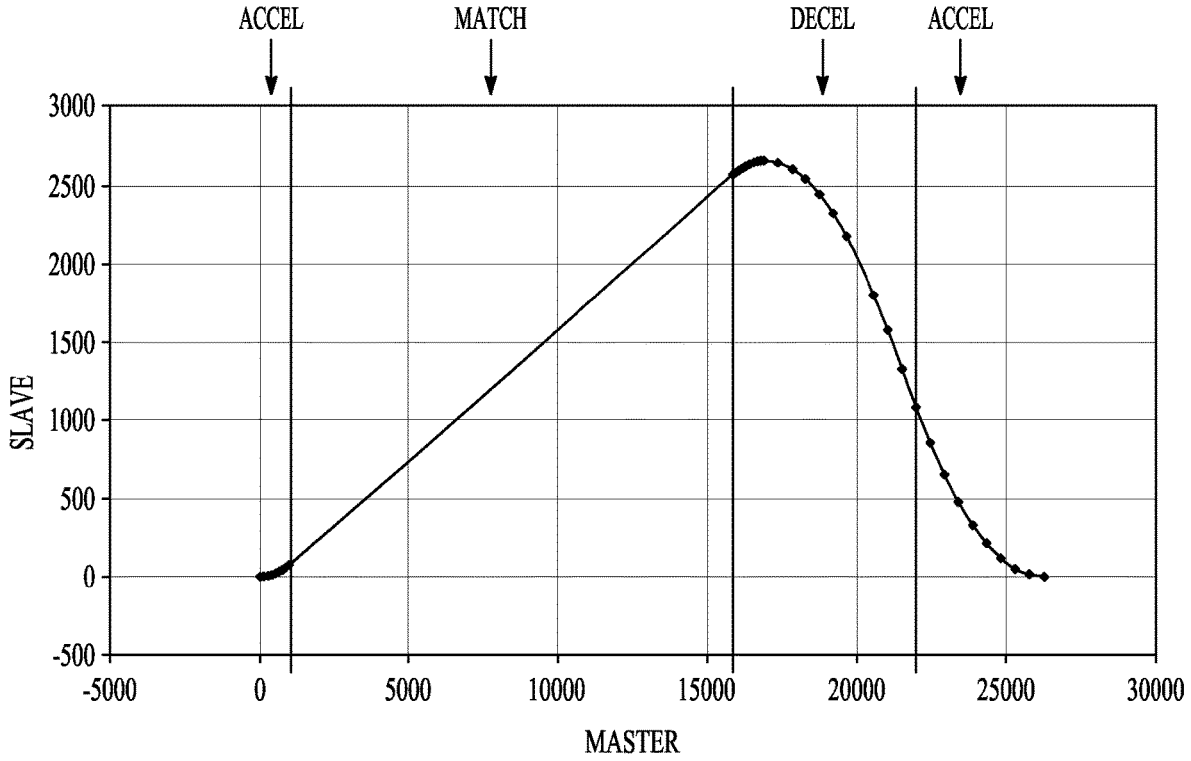

FIG. 9A illustrates an example of a Position CAM (PCAM) profile for controlling motion of the semi-rotary accumulator to place parts on the part transfer station illustrated in FIG. 8. The PCAM profile illustrates the acceleration of the first web speed until the first web matches the speed of the web. After the web speed matches, the part is placed. After the part is placed, the first web is decelerated for a time to increase the part space on the second web, and then accelerated again to repeat the profile. The PCAM profile is described illustrated units of length (e.g. inches). A user may input values to control the motion during the PCAM profile, including the part-to-part spacing ("Pre Accumulator Length) of the first web, the part-to-part spacing ("Post Accumulator Length) of the second web, and the part length ("Match Length). The lengths on the bottom of FIG. 9 are based on the part-to-part spacing on the first web, the part-to part spacing on the second web, and the part length. The gear ratio of the first web may be slaved off of the gear ratio of the second web. Thus, "match" being at 0.0937 inches, deceleration begins at 1.5937 inches, etc. FIG. 9B illustrates, using motor counts, the relationship between master and slave throughout the PCAM profile. The master is the same as the master in FIG. 9A, but in motor counts rather than inches. The slave represents the position of the movable idlers shafts throughout the cam profile. The linear portion represents the "Match" portion of the profile where the slave gear ratio is constant, the concave up portion represents the acceleration portion of the profile where the slave gear ratio is increasing, and the concave down portion represents the deceleration portion of the profile where the slave gear ratio is decreasing.

Figure 10:
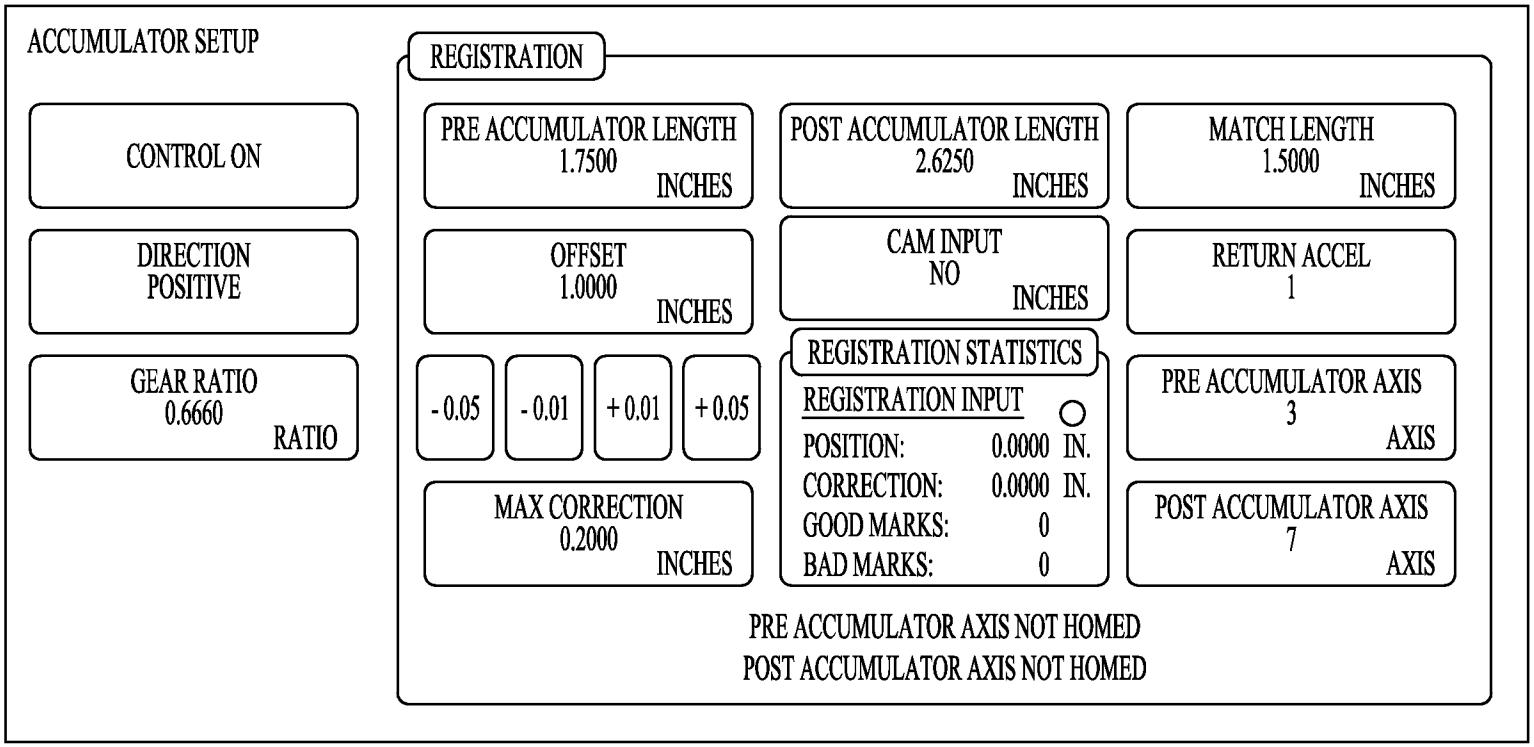
FIG. 10 illustrates an embodiment of a user interface to program the PCAM profile.

FIG. 10 illustrates an embodiment of a user interface to program the PCAM profile. In the illustrated embodiment, a user may select whether to turn on the accumulator using the Control On" button. Also, as servo motors may be used, the user can program a gear ratio. The pre-accumulator length, post-accumulator length and match length may be entered, as well as a maximum correction and offset to maintain registration during the part transfer. The user may also program the axis on the web processing system to be used to monitor pre-accumulator and post accumulator.

Figure 11:
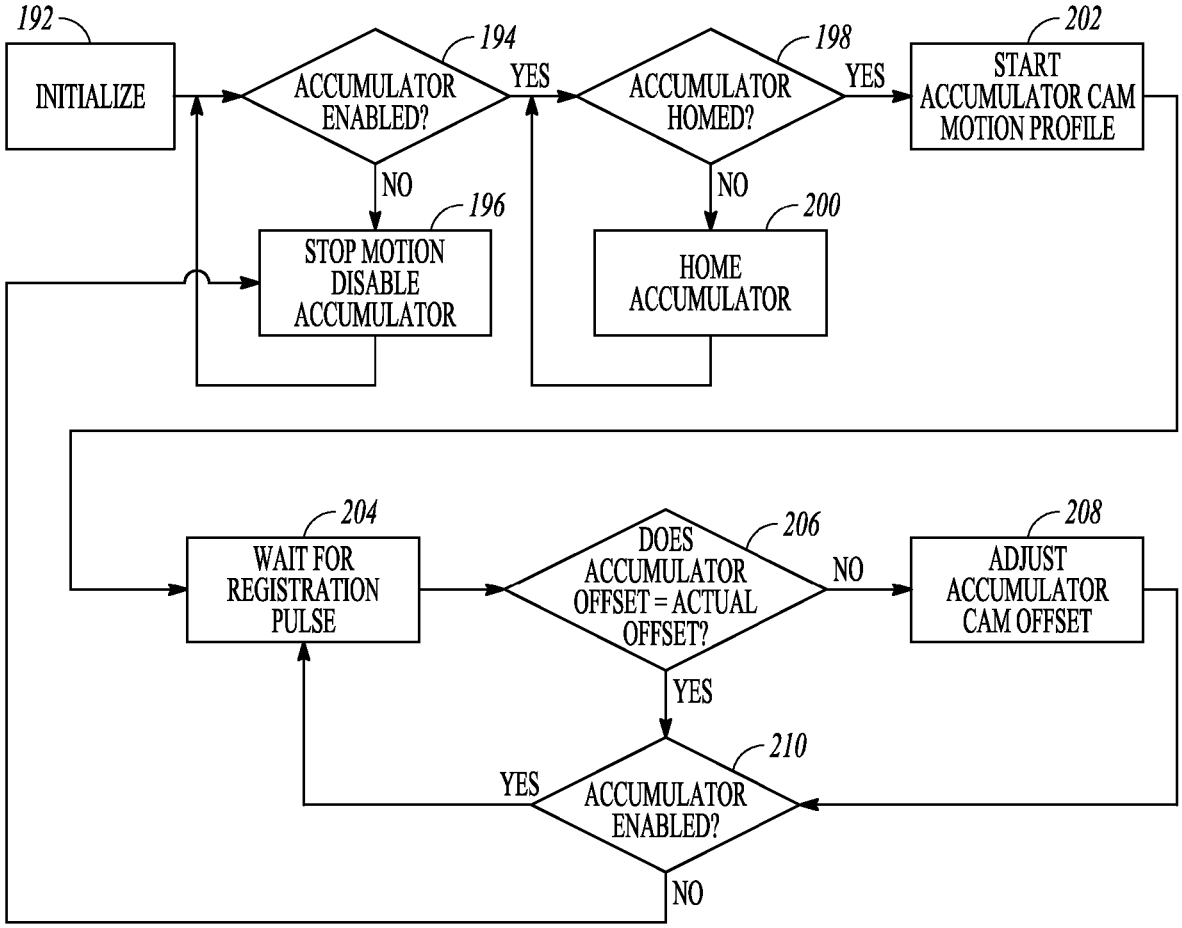
FIG. 11 is an embodiment of a method for operating the semi-rotary accumulator.

FIG. 11 is an embodiment of a method for operating the semi-rotary accumulator. The system is initialized at 192, and a check is performed to determine if the system has enabled the accumulator at 194. If the accumulator is not enabled then the motion is stopped and the accumulator is disabled 196. If the accumulator is enabled, then a check is performed to determine whether the accumulator is homed 198. The accumulator is homed at 200 if not already homed. If the accumulator is homed, then the cam profile is started 202, and the accumulator waits for a registration pulse 204 from the system. In response to a received registration pulse, a check is performed to determine if the accumulator offset equals the actual offset 206. If the offsets are not equal, then the accumulator adjusts the accumulator cam offset 208, and then performs a check to determine if the system has enabled the accumulator at 210. If the accumulator is enabled at 210, then the process returns to 204 to wait for a registration pulse. If the accumulator is not enabled at 210, then the process returns to 196 to stop motion and disable the accumulator.

Figure 13A:
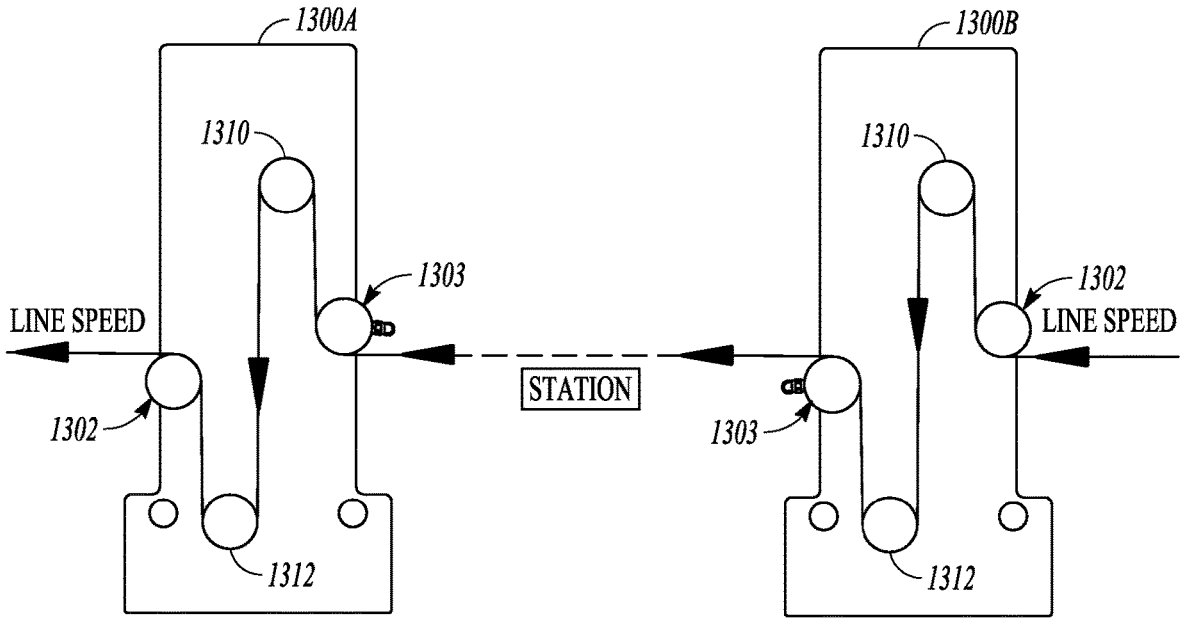
FIGS. 13A-13B illustrate a system with more than one semi-rotary accumulator configured to work together to increase accumulation length and thus increase potential line speeds.
Figure 13B:
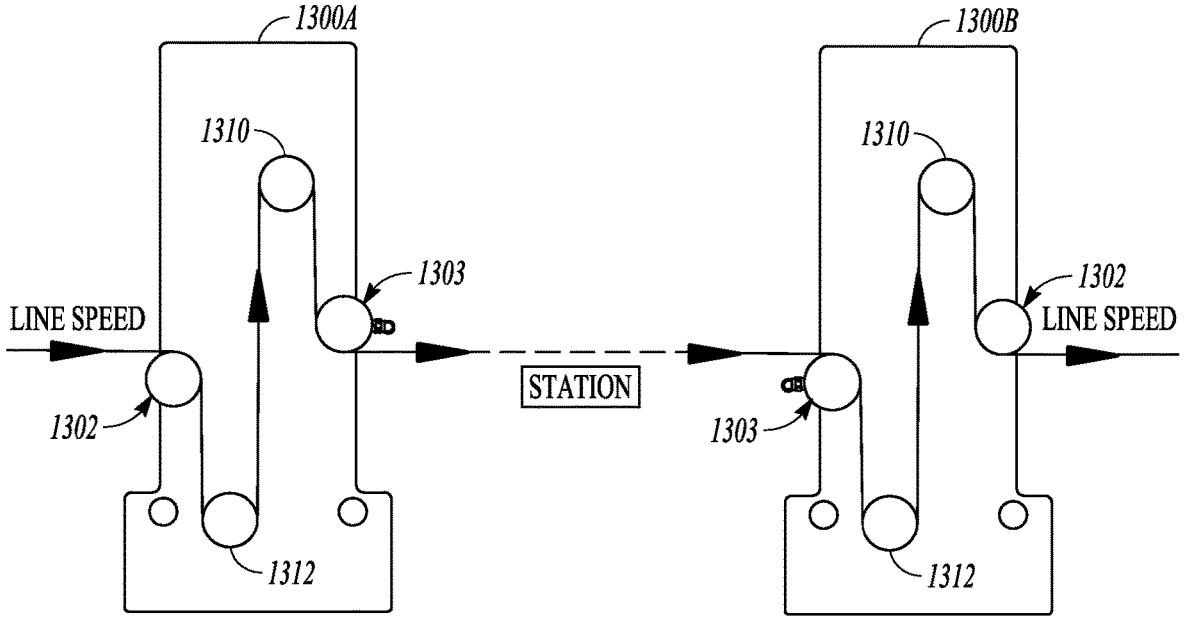

FIGS. 13A-13B illustrate a system with more than one semi-rotary accumulator ganged in series. For example, two accumulators 1300A and 1300B arranged in series and configured to synchronously operate together can theoretically double the accumulation and increase process speed. Each of the illustrated accumulators includes an idler shaft 1302, an air bar 1303, and movable idler shafts 1310 and 1312. The air bar 1303 is used as a turn bar on the on the side of the accumulator with the variable web speed. The air bar 1303 removes the inertia on the web between the accumulators where most of the web agitation occurs.

FIGS. 14A-14D illustrate first, second, third and fourth examples of semi-rotary accumulators with an air bar configured to handle web moving through various web paths in the right-to-left direction. The first example of the accumulator, illustrated in FIG. 14A, receives a horizontally-oriented web past idler shaft 1402. The web passes around movable idlers shafts 1410 and 1412, and then is output past air bar 1403 as a horizontally-oriented web. The second example of the accumulator, illustrated in FIG. 14B, receives an upwardly moving, vertically oriented web past an outboard-mounted idler shaft 1416 and past idler shaft 1402. The web passes around movable idlers shafts 1410 and 1412, and then past air bar 1403 and then output as a horizontally-oriented web. The third example of the accumulator, illustrated in FIG. 14C, receives a horizontally-oriented web past idler shaft 1402. The web passes around movable idlers shafts 1410 and 1412, and then past air bar 1403 and outboard-mounted idler shaft 1418 as an upwardly-moving, vertically-oriented web. The fourth example of the accumulator, illustrated in FIG. 14D, receives an upwardly-moving, vertically-oriented web past an outboard-mounted idler shaft 1416 and idler shaft 1402. The web passes around movable idlers shafts 1410 and 1412, and then past air bar 1403 and outboard-mounted idler shaft 1418 then output as an upwardly-moving, vertically-oriented web.

FIGS. 15A-15D illustrate fifth, sixth, seventh and eighth examples of semi-rotary accumulators with an air bar configured to handle web moving through various web paths in the right-to-left direction. The fifth example of the accumulator, illustrated in FIG. 15A, receives a horizontally-oriented web past idler shaft 1502. The web passes around movable idlers shafts 1512 and 1514, and then is output past air bar 1503 as a horizontally-oriented web. The sixth example of the accumulator, illustrated in FIG. 15B, receives horizontally-oriented web past idler shaft 1502. The web passes around movable idlers shafts 1512 and 1514, and then is output past air bar 1503 and outboard mounted idler shaft 1516 as a downwardly-moving, vertically-oriented web. The seventh example of the accumulator, illustrated in FIG. 15C, receives a downwardly-moving, vertically-oriented web past outboard-mounted idler shaft 1518 and idler shaft 1502. The web passes around movable idlers shafts 1512 and 1510, and then is output past air bar 1503 as a horizontally-oriented web. The eighth example of the accumulator, illustrated in FIG. 15D, receives a downwardly-moving, vertically-oriented web past an outboard-mounted idler shaft 1518 and idler shaft 1502. The web passes around movable idlers shafts 1512 and 1510, and then past air bar 1503 and outboard-mounted idler shaft 1516 then output as a downwardly-moving, vertically-oriented web.

Those of ordinary skill in the art will understand, upon reading and comprehending this disclosure, how to gang together various embodiments of semi-rotary accumulators to accommodate various web paths along a web handling machine. The semi-rotary accumulator embodiments may include one or more of the embodiments illustrated herein, or may include other embodiments with other web directions that are not expressly disclosed herein.

Figure 14A:
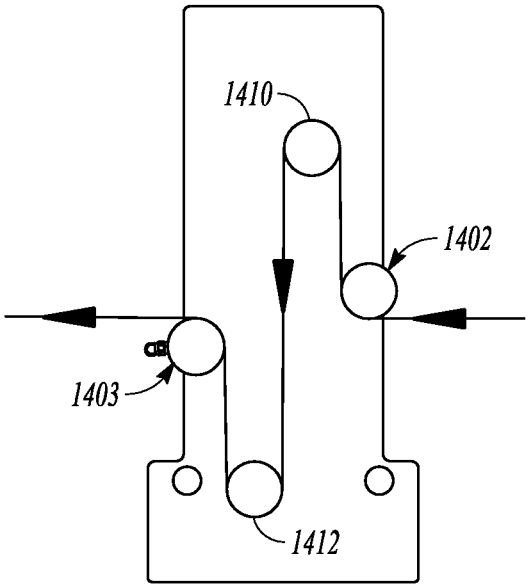
FIGS. 14A-14D illustrate first, second, third and fourth examples of semi-rotary accumulators with an air bar configured to handle web moving through various web paths in the right-to-left direction.
Figure 16B:
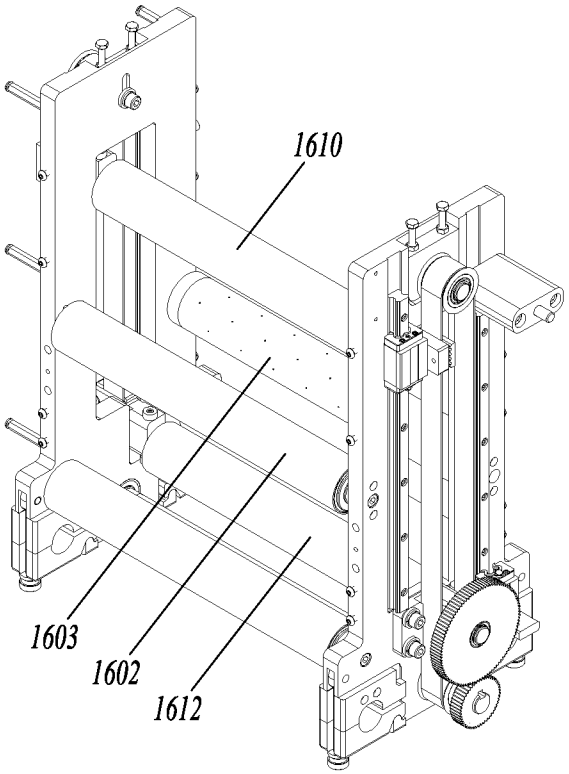
FIGS. 16A-16E further illustrate the first example of the semi-rotary accumulator of FIG. 14A, a web path, and motion of the movable idlers shafts within the semi-rotary accumulator.
Figure 16A:
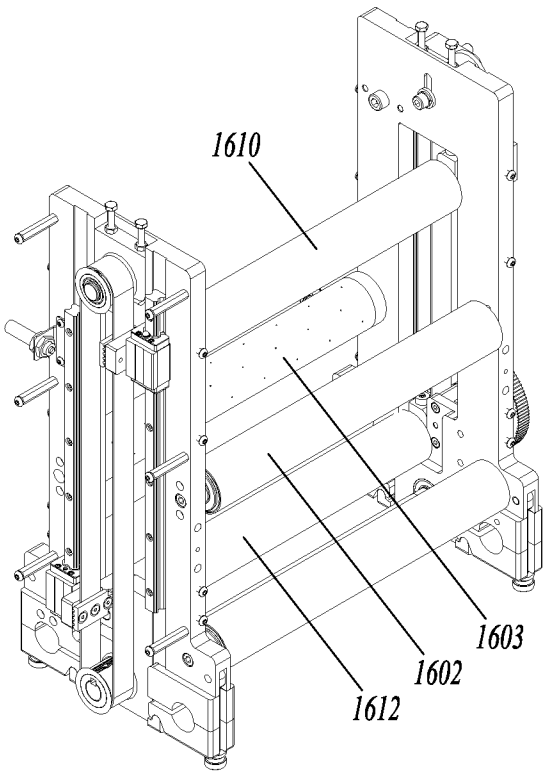
Figure 16E:
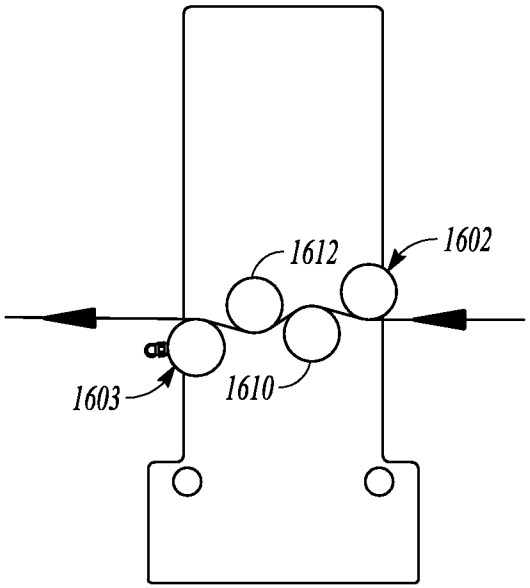
Figure 16D:
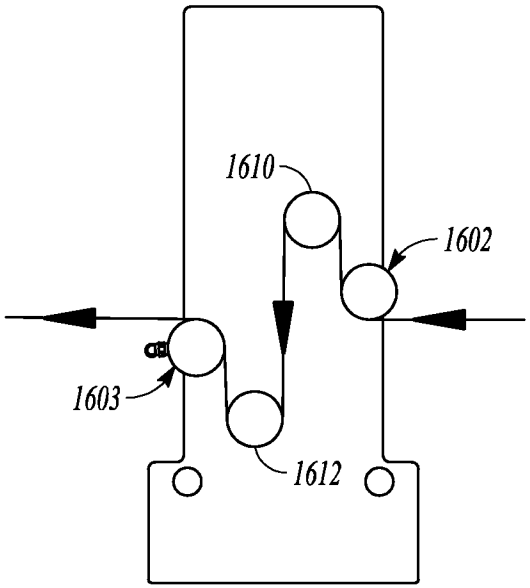
Figure 16C:
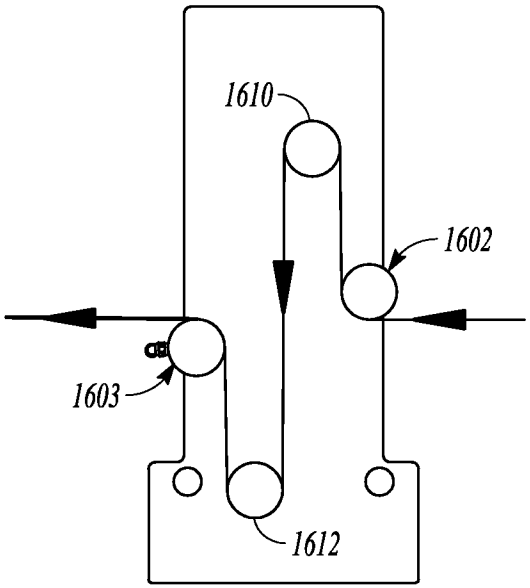

FIGS. 16A-16E further illustrate the first example of the semi-rotary accumulator of FIG. 14A, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes an idler shaft 1602, air bar 1603, and movable idler shafts 1610 and 1612. FIGS. 16C-16E illustrate web paths and further illustrate motion of the movable idlers shafts within the semi-rotary accumulator. These figures illustrate a schematic side view of the accumulator to illustrate the relative positions. The first and second movable idler shafts 1610 and 1612 move together in concert as their motion may be mechanically (e.g. belt, gear) or electronically linked together. Simultaneous movement of the first movable idler shaft 1610 and the second movable idler shaft 1612 toward the positions illustrated in FIG. 16E decreases a length of the web path between the idler shaft 1602 and air bar 1603. The reverse motion of the first and second movable idlers shafts 1610 and 1612 back toward the positions illustrated in FIG. 16C increases the length of the web path between the idler shaft 1602 and air bar 1603. The idler shaft 1602 and air bar 1603 may have fixed axes to avoid introducing additional inertia into the web. However, a system may be designed to provide the complementary web length changes using non-fixed axes. Furthermore, the diameter of the idler shafts is not intended to limit the scope of the present subject matter.

Figure 14B:
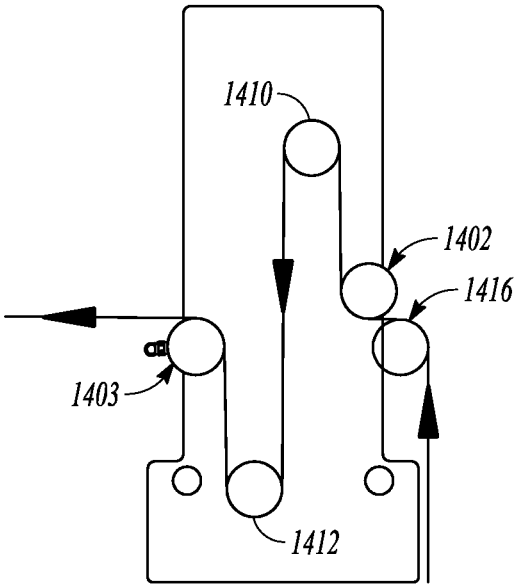
Figure 17B:
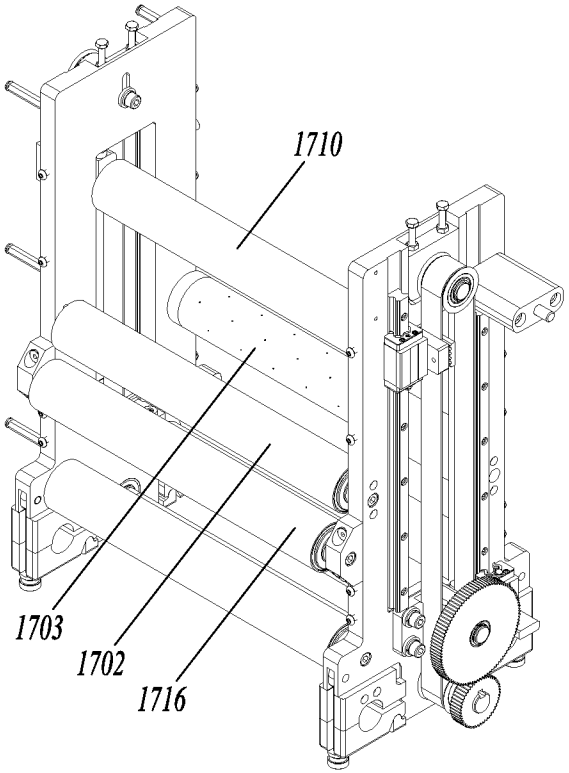
FIGS. 17A-17E further illustrate the second example of the semi-rotary accumulator of FIG. 14B, a web path, and motion of the movable idlers shafts within the semi-rotary accumulator.
Figure 17A:
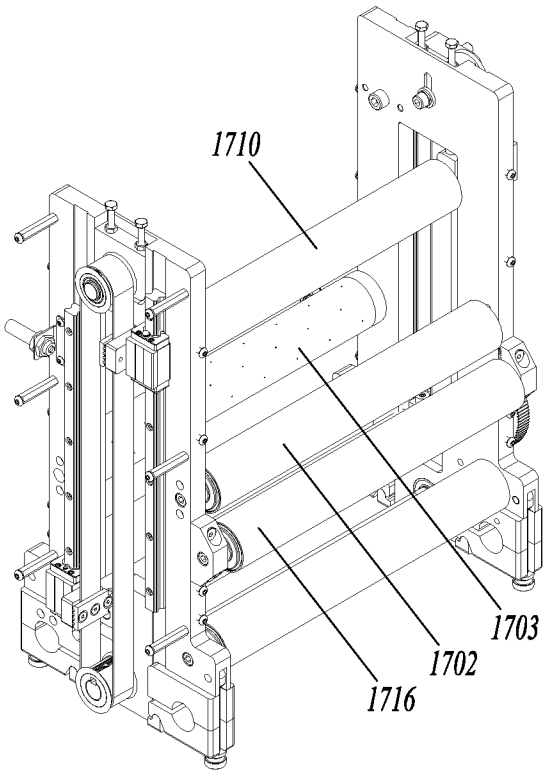
Figures 17C, 17D, 17E:
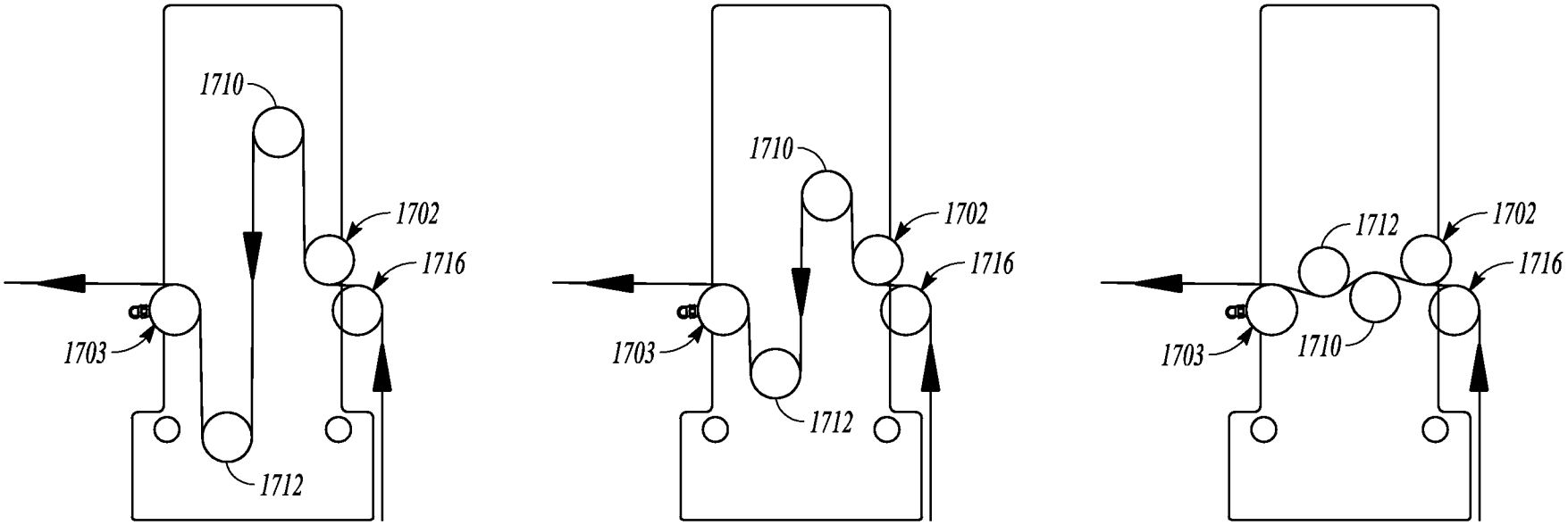

FIGS. 17A-17E further illustrate the second example of the semi-rotary accumulator of FIG. 14B, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes an outboard-mounted idler shaft 1716, idler shaft 1702, air bar 1703, and movable idler shafts 1710 and 1712. FIGS. 17C-17E illustrate web paths and further illustrate motion of the movable idlers shafts within the semi-rotary accumulator. These figures illustrate a schematic side view of the accumulator to illustrate the relative positions. The first and second movable idler shafts 1710 and 1712 move together in concert as their motion may be mechanically (e.g. belt, gear) or electronically linked together. Simultaneous movement of the first movable idler shaft 1710 and the second movable idler shaft 1712 toward the positions illustrated in FIG. 17E decreases a length of the web path between the idler shaft 1702 and air bar 1703. The reverse motion of the first and second movable idlers shafts 1710 and 1712 back toward the positions illustrated in FIG. 17C increases the length of the web path between the idler shaft 1702 and air bar 1703. The idler shaft 1702 and air bar 1703 may have fixed axes to avoid introducing additional inertia into the web. However, a system may be designed to provide the complementary web length changes using non-fixed axes. Furthermore, the diameter of the idler shafts is not intended to limit the scope of the present subject matter.

Figure 14C:
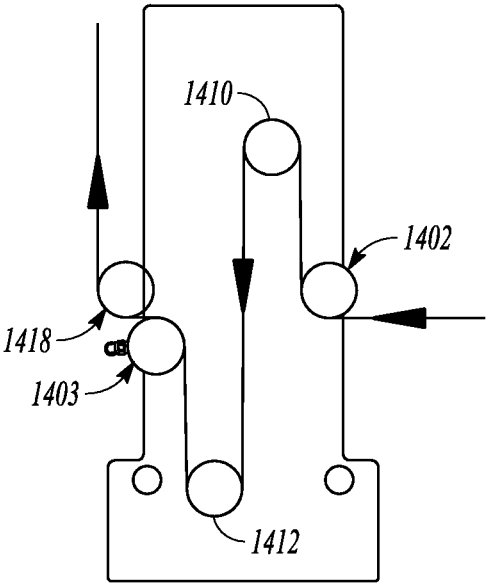
Figure 18B:
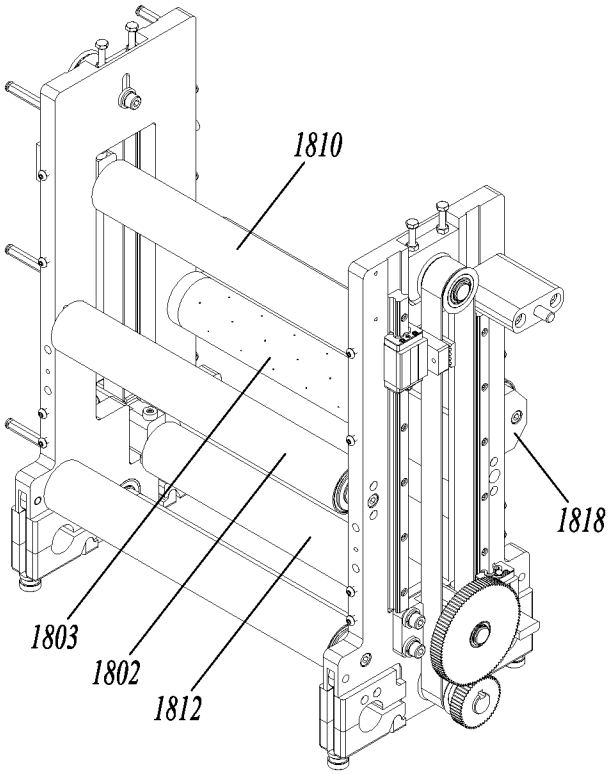
FIGS. 18A-18E further illustrate the third example of the semi-rotary accumulator of FIG. 14C, a web path, and motion of the movable idlers shafts within the semi-rotary accumulator.
Figure 18A:
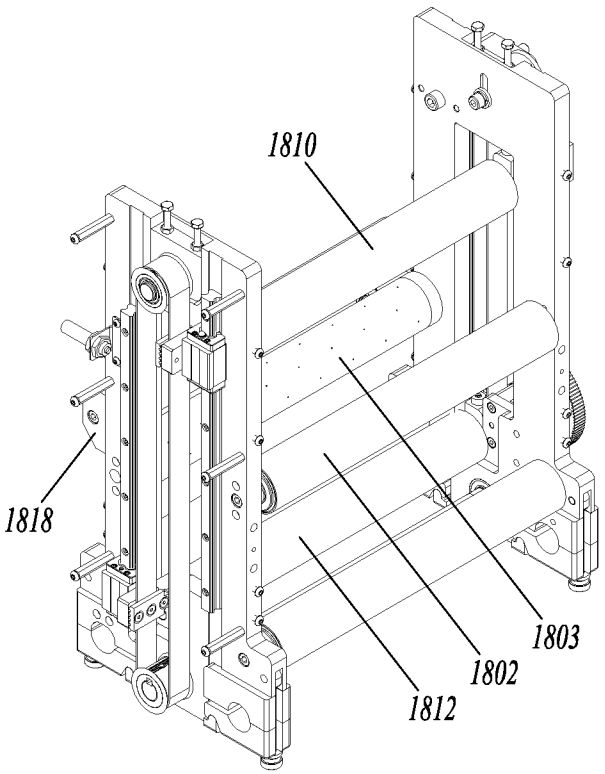
Figure 18E:
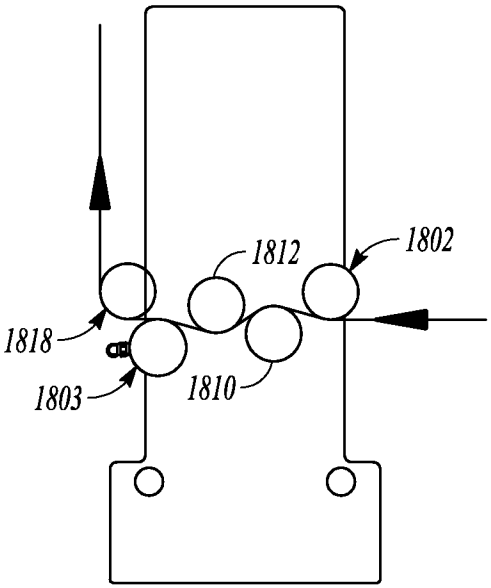
Figure 18D:
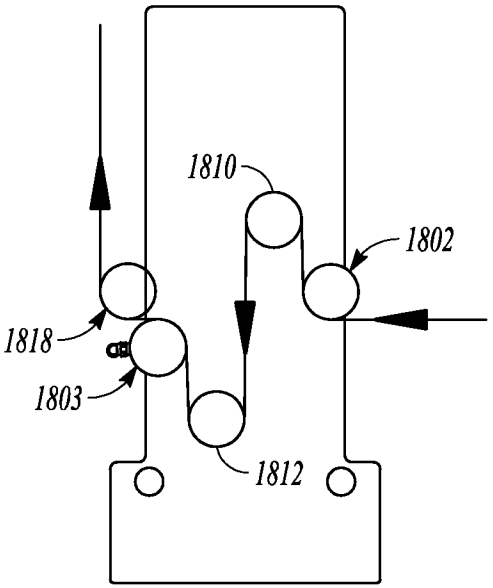
Figure 18C:
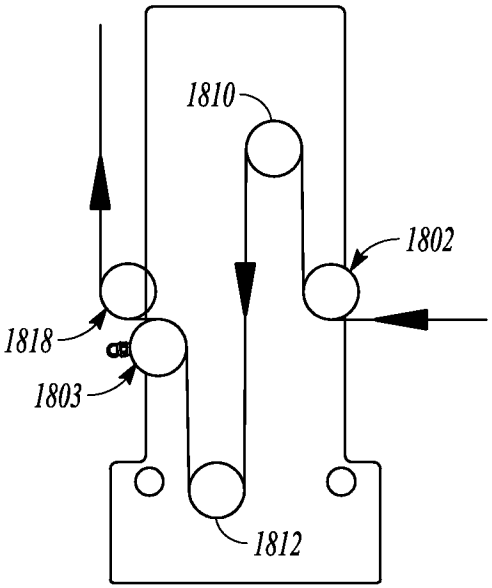

FIGS. 18A-18E further illustrate the third example of the semi-rotary accumulator of FIG. 14C, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes an outboard-mounted idler shaft 1818, idler shaft 1802, air bar 1803, and movable idler shafts 1810 and 1812. FIGS. 18C-18E illustrate web paths and further illustrate motion of the movable idlers shafts within the semi-rotary accumulator. These figures illustrate a schematic side view of the accumulator to illustrate the relative positions. The first and second movable idler shafts 1810 and 1812 move together in concert as their motion may be mechanically (e.g. belt, gear) or electronically (e.g. servo motor control) linked together. Simultaneous movement of the first movable idler shaft 1810 and the second movable idler shaft 1812 toward the positions illustrated in FIG. 18E decreases a length of the web path between the idler shaft 1802 and air bar 1803. The reverse motion of the first and second movable idlers shafts 1810 and 1812 back toward the positions illustrated in FIG. 18C increases the length of the web path between the idler shaft 1802 and air bar 1803. The idler shaft 1802 and air bar 1803 may have fixed axes to avoid introducing additional inertia into the web. However, a system may be designed to provide the complementary web length changes using non-fixed axes. Furthermore, the diameter of the idler shafts is not intended to limit the scope of the present subject matter.

Figure 14D:
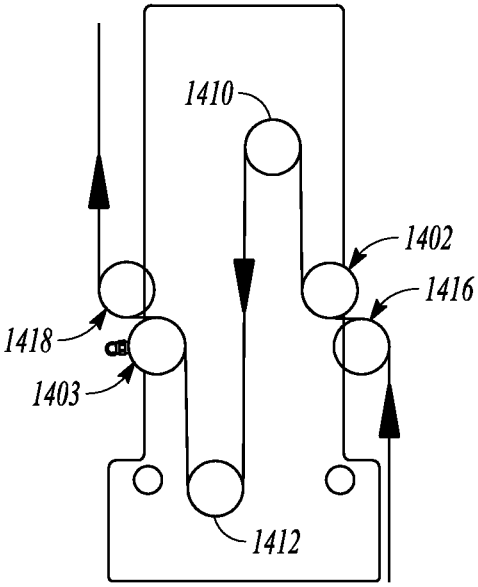
Figure 19B:
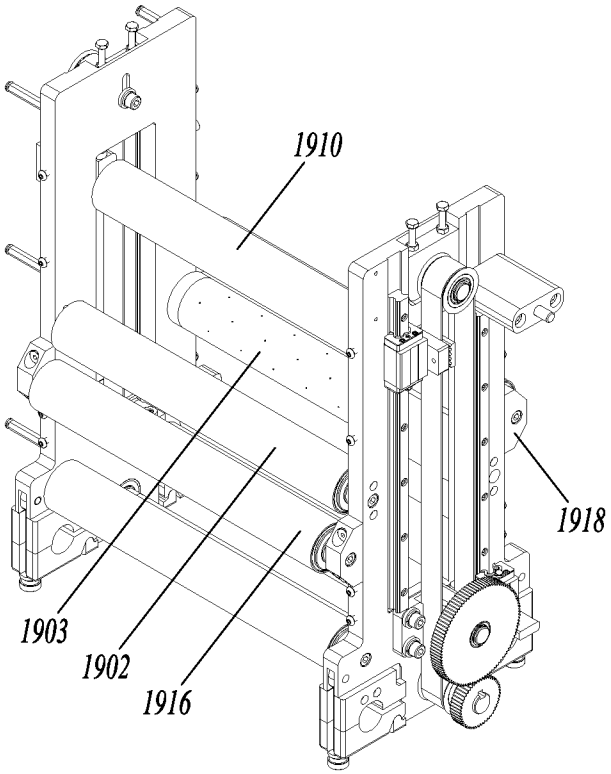
FIGS. 19A-19E further illustrate the fourth example of the semi-rotary accumulator of FIG. 14D, a web path, and motion of the movable idlers shafts within the semi-rotary accumulator.
Figure 19A:
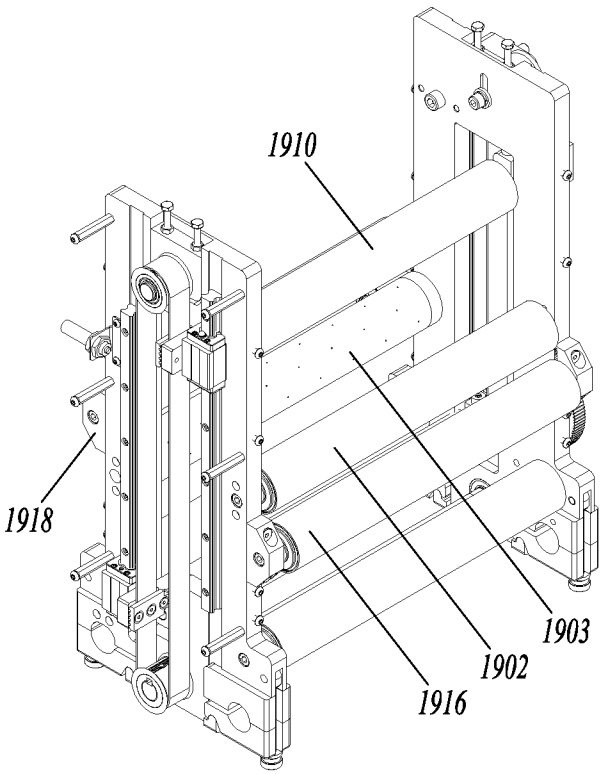
Figure 19E:
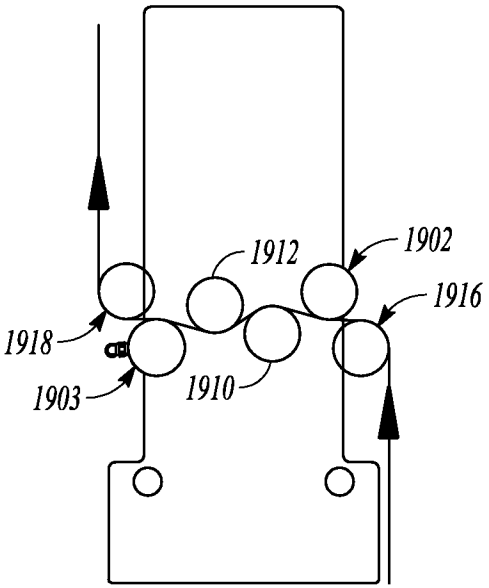
Figure 19D:
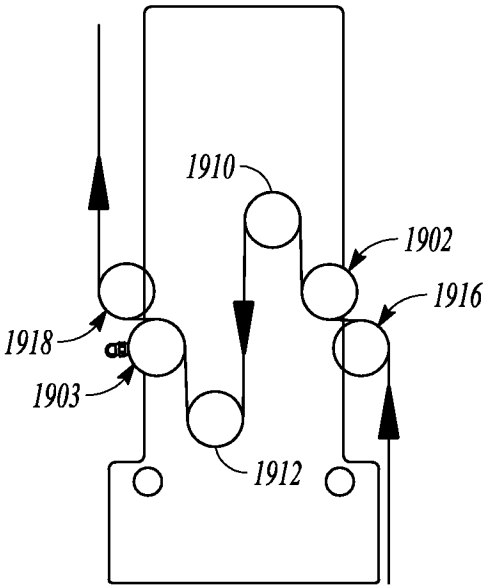
Figure 19C:
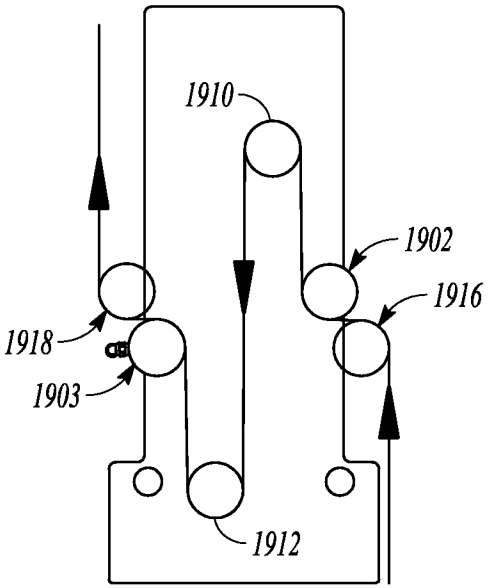

FIGS. 19A-19E further illustrate the fourth example of the semi-rotary accumulator of FIG. 14D, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes outboard-mounted idler shafts 1916 and 1918, idler shaft 1902, air bar 1903, and movable idler shafts 1910 and 1912. FIGS. 19C-19E illustrate web paths and further illustrate motion of the movable idlers shafts within the semi-rotary accumulator. These figures illustrate a schematic side view of the accumulator to illustrate the relative positions. The first and second movable idler shafts 1910 and 1912 move together in concert as their motion may be mechanically (e.g. belt, gear) or electronically (e.g. servo motor control) linked together. Simultaneous movement of the first movable idler shaft 1910 and the second movable idler shaft 1912 toward the positions illustrated in FIG. 19E decreases a length of the web path between the idler shaft 1902 and air bar 1903. The reverse motion of the first and second movable idlers shafts 1910 and 1912 back toward the positions illustrated in FIG. 19C increases the length of the web path between the idler shaft 1902 and air bar 1903. The idler shaft 1902 and air bar 1903 may have fixed axes to avoid introducing additional inertia into the web. However, a system may be designed to provide the complementary web length changes using non-fixed axes. Furthermore, the diameter of the idler shafts is not intended to limit the scope of the present subject matter.

Figure 15A:
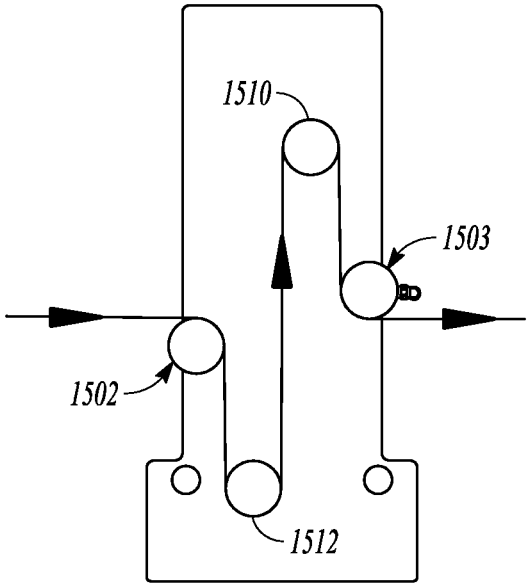
FIGS. 15A-15D illustrate fifth, sixth, seventh and eighth examples of semi-rotary accumulators with an air bar configured to handle web moving through various web paths in the right-to-left direction.
Figure 20B:
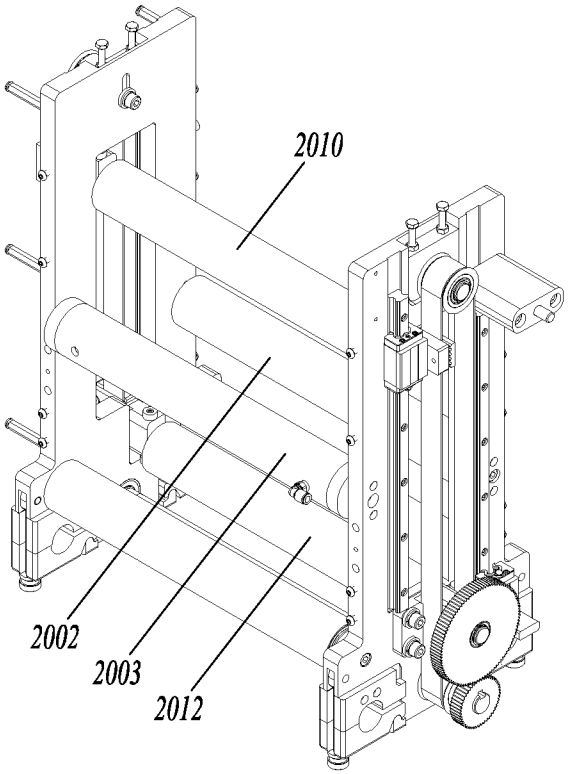
FIGS. 20A-20E further illustrate the fifth example of the semi-rotary accumulator of FIG. 15A, a web path, and motion of the movable idlers shafts within the semi-rotary accumulator.
Figure 20A:
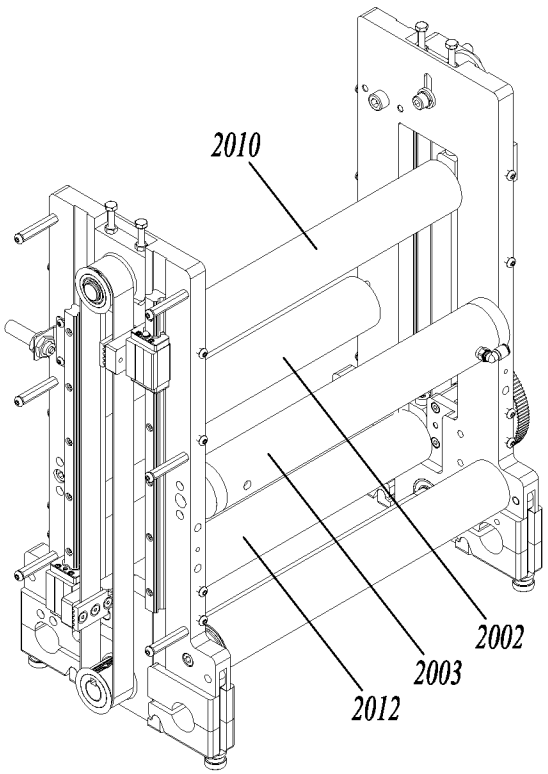
Figure 20E:
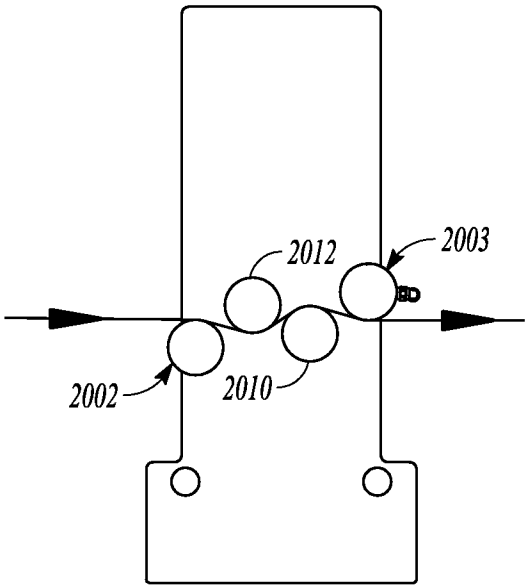
Figure 20D:
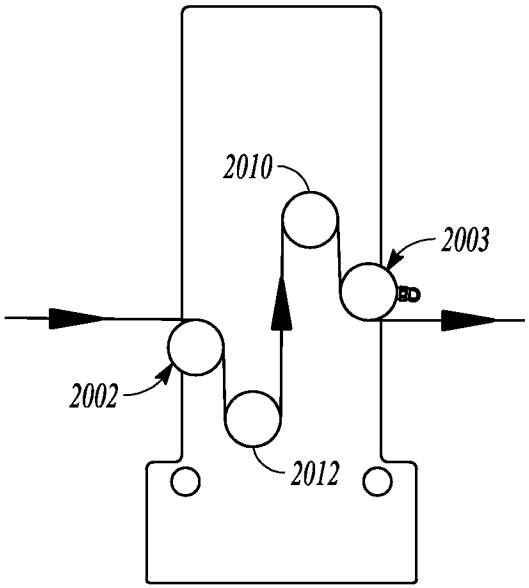
Figure 20C:
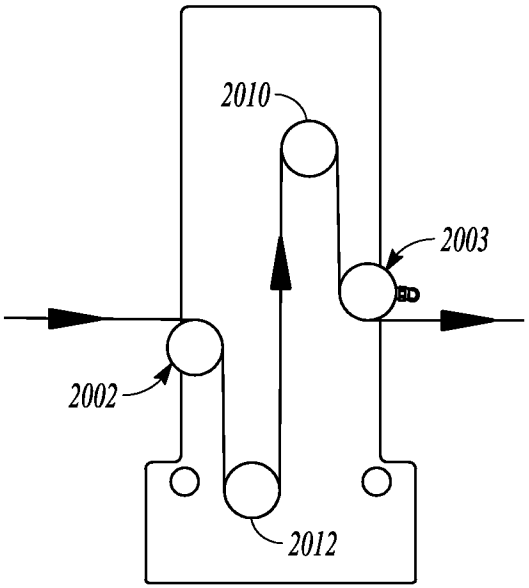

FIGS. 20A-20E further illustrate the fifth example of the semi-rotary accumulator of FIG. 15A, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes an idler shaft 2002, air bar 2003, and movable idler shafts 2010 and 2012. FIGS. 20C-20E illustrate web paths and further illustrate motion of the movable idlers shafts within the semi-rotary accumulator. These figures illustrate a schematic side view of the accumulator to illustrate the relative positions. The first and second movable idler shafts 2010 and 2012 move together in concert as their motion may be mechanically (e.g. belt, gear) or electronically linked together. Simultaneous movement of the first movable idler shaft 2010 and the second movable idler shaft 2012 toward the positions illustrated in FIG. 20E decreases a length of the web path between the idler shaft 2002 and air bar 2003. The reverse motion of the first and second movable idlers shafts 2010 and 2012 back toward the positions illustrated in FIG. 20C increases the length of the web path between the idler shaft 2002 and air bar 2003. The idler shaft 2002 and air bar 2003 may have fixed axes to avoid introducing additional inertia into the web. However, a system may be designed to provide the complementary web length changes using non-fixed axes. Furthermore, the diameter of the idler shafts is not intended to limit the scope of the present subject matter.

Figure 15B:
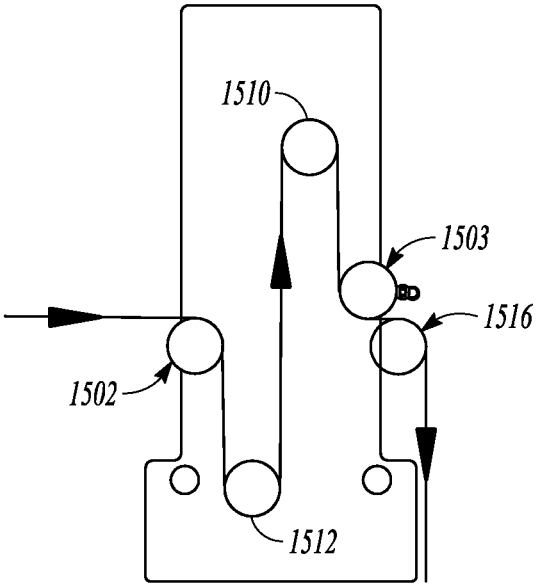
Figure 21B:
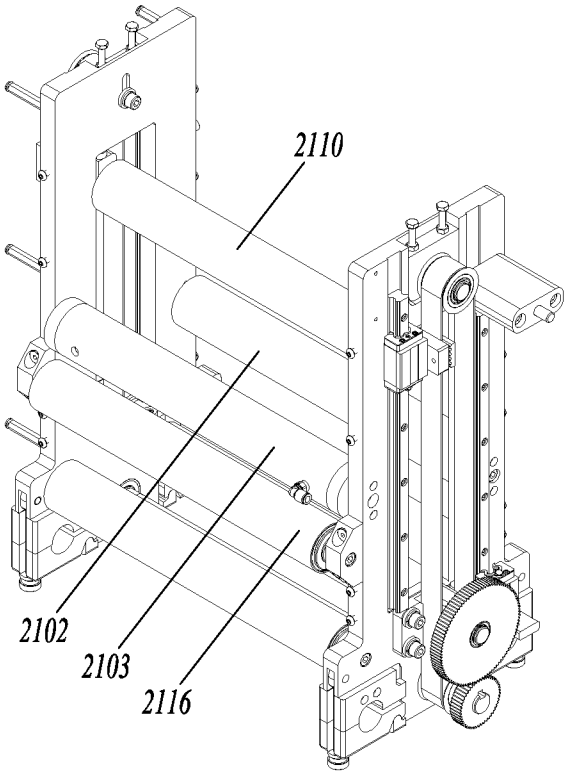
FIGS. 21A-21E further illustrate the sixth example of the semi-rotary accumulator of FIG. 15B, a web path, and motion of the movable idlers shafts within the semi-rotary accumulator.
Figure 21A:
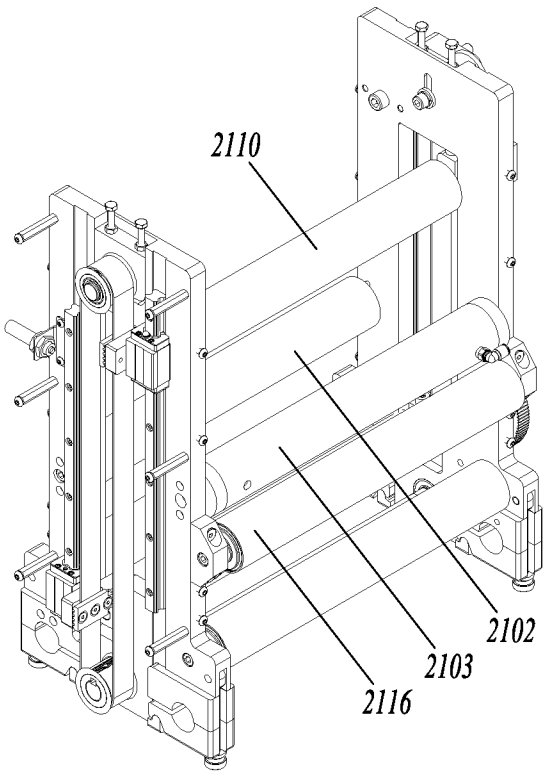
Figure 21E:
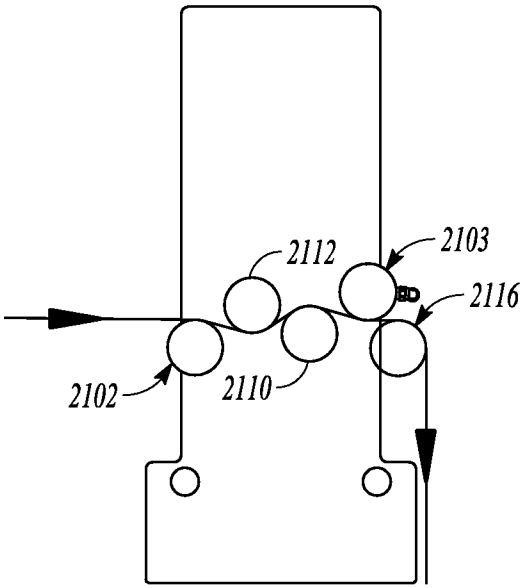
Figure 21D:
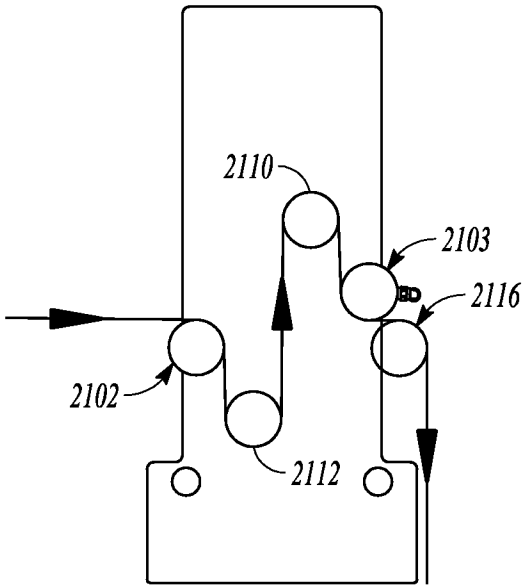
Figure 21C:
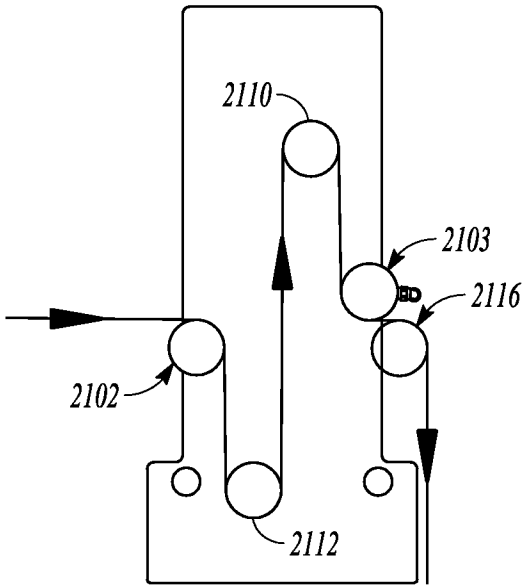

FIGS. 21A-21E further illustrate the sixth example of the semi-rotary accumulator of FIG. 15B, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes an outboard-mounted idler shaft 2116, idler shaft 2102, air bar 2103, and movable idler shafts 2110 and 2112. FIGS. 21C-21E illustrate web paths and further illustrate motion of the movable idlers shafts within the semi-rotary accumulator. These figures illustrate a schematic side view of the accumulator to illustrate the relative positions. The first and second movable idler shafts 2110 and 2112 move together in concert as their motion may be mechanically (e.g. belt, gear) or electronically linked together. Simultaneous movement of the first movable idler shaft 2110 and the second movable idler shaft 2112 toward the positions illustrated in FIG. 21E decreases a length of the web path between the idler shaft 2102 and air bar 2103. The reverse motion of the first and second movable idlers shafts 2110 and 2112 back toward the positions illustrated in FIG. 21C increases the length of the web path between the idler shaft 2102 and air bar 2103. The idler shaft 2102 and air bar 2103 may have fixed axes to avoid introducing additional inertia into the web. However, a system may be designed to provide the complementary web length changes using non-fixed axes. Furthermore, the diameter of the idler shafts is not intended to limit the scope of the present subject matter.

Figure 15C:
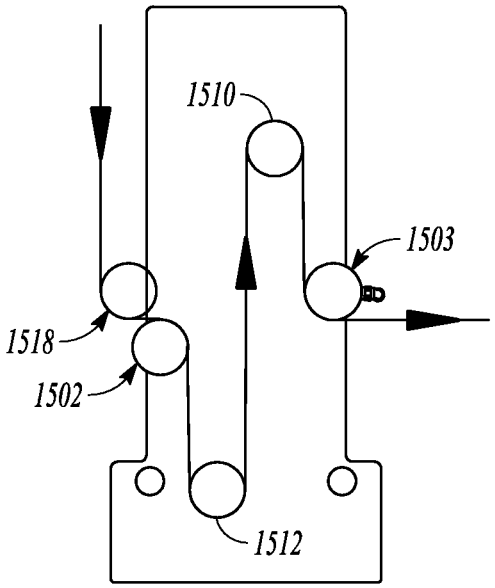
Figure 22B:
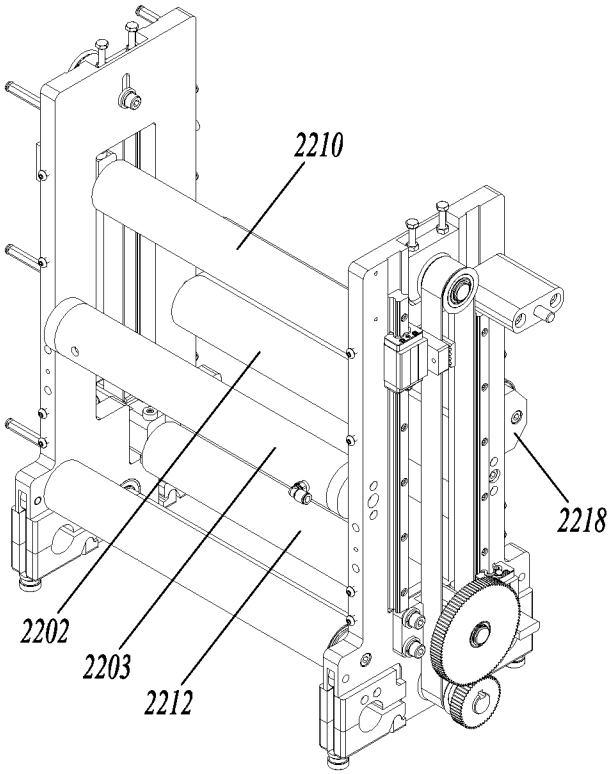
FIGS. 22A-22E further illustrate the seventh example of the semi-rotary accumulator of FIG. 15C, a web path, and motion of the movable idlers shafts within the semi-rotary accumulator.
Figure 22A:
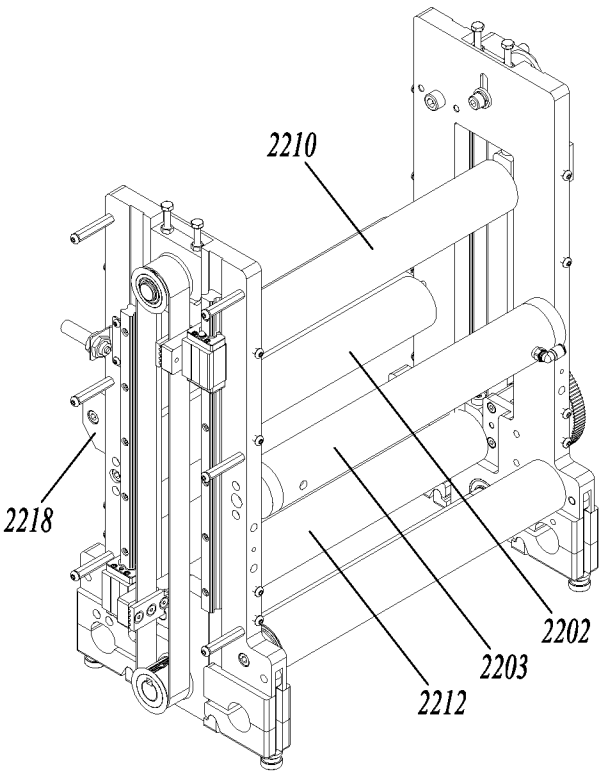
Figure 22C:
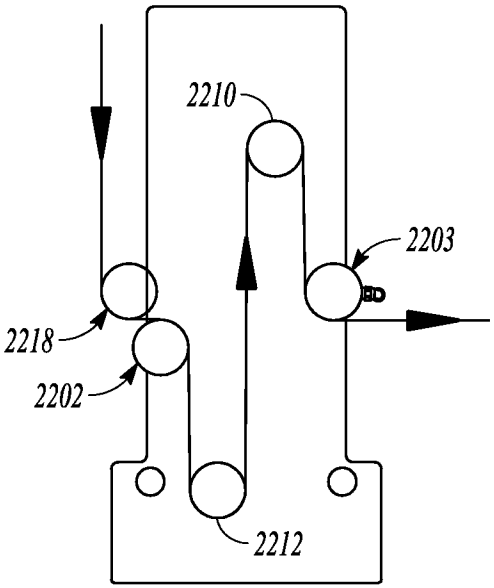
Figure 22D:
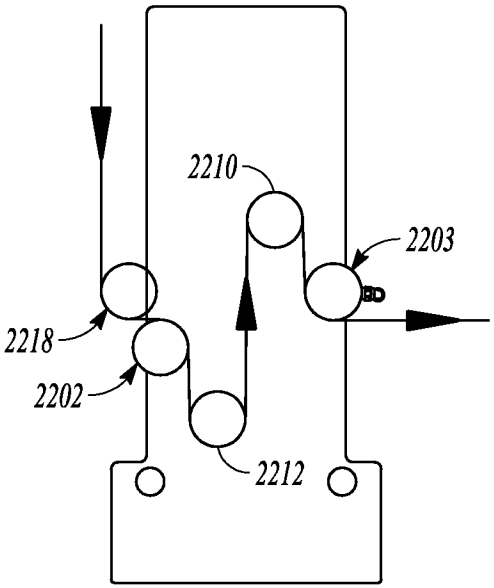
Figure 22E:
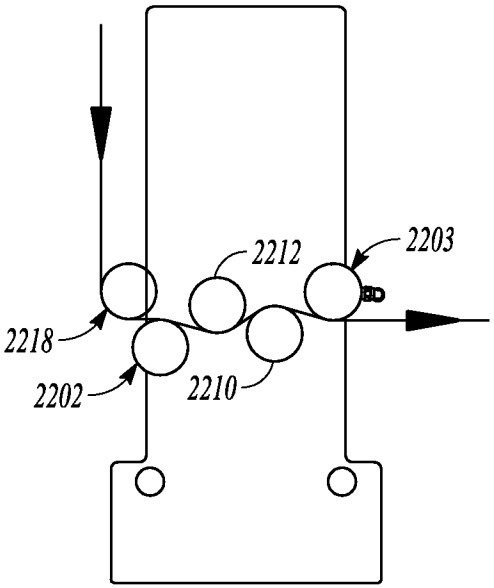

FIGS. 22A-22E further illustrate the seventh example of the semi-rotary accumulator of FIG. 15C, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes an outboard-mounted idler shaft 2218, idler shaft 2202, air bar 2203, and movable idler shafts 2210 and 2212. FIGS. 22C-22E illustrate web paths and further illustrate motion of the movable idlers shafts within the semi-rotary accumulator. These figures illustrate a schematic side view of the accumulator to illustrate the relative positions. The first and second movable idler shafts 2210 and 2212 move together in concert as their motion may be mechanically (e.g. belt, gear) or electronically (e.g. servo motor control) linked together. Simultaneous movement of the first movable idler shaft 2210 and the second movable idler shaft 2212 toward the positions illustrated in FIG. 22E decreases a length of the web path between the idler shaft 2202 and air bar 2203. The reverse motion of the first and second movable idlers shafts 2210 and 2212 back toward the positions illustrated in FIG. 22C increases the length of the web path between the idler shaft 2202 and air bar 2203. The idler shaft 2202 and air bar 2203 may have fixed axes to avoid introducing additional inertia into the web. However, a system may be designed to provide the complementary web length changes using non-fixed axes. Furthermore, the diameter of the idler shafts is not intended to limit the scope of the present subject matter.

Figure 15D:
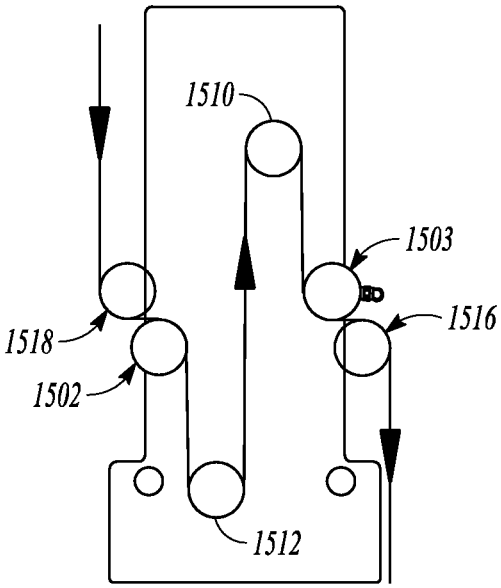
Figure 23B:
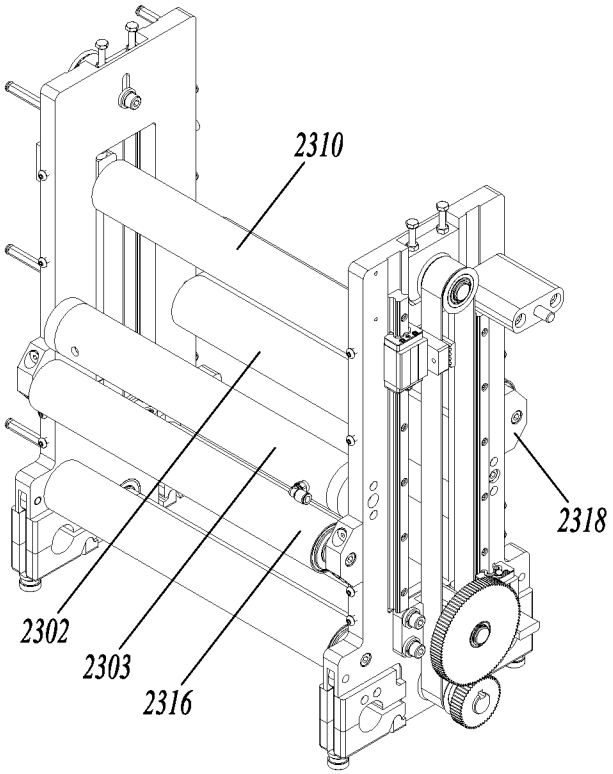
FIGS. 23A-23E further illustrate the eighth example of the semi-rotary accumulator of FIG. 15D, a web path, and motion of the movable idlers shafts within the semi-rotary accumulator.
Figure 23A:
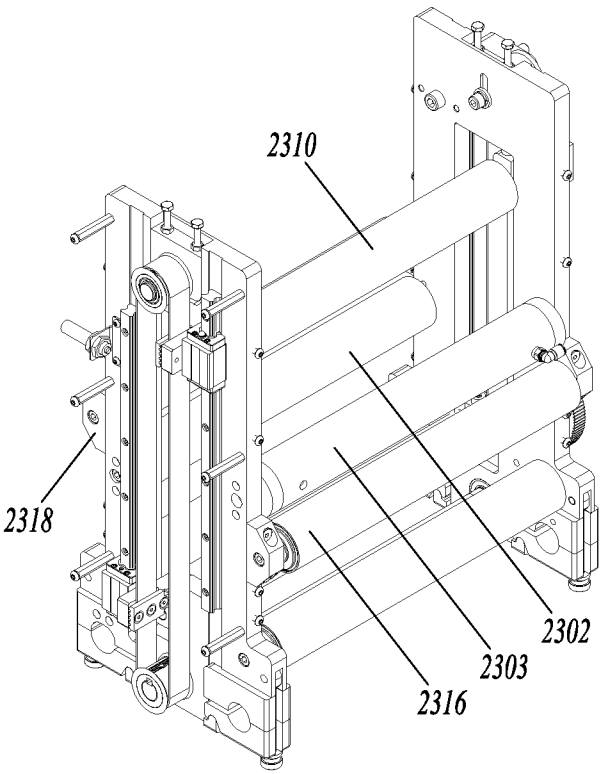
Figure 23E:
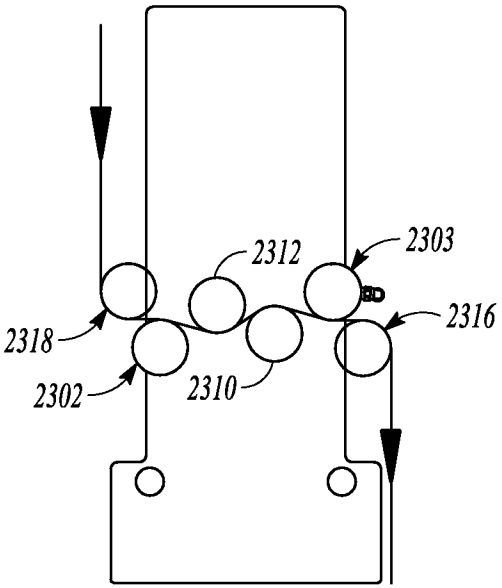
Figure 23D:
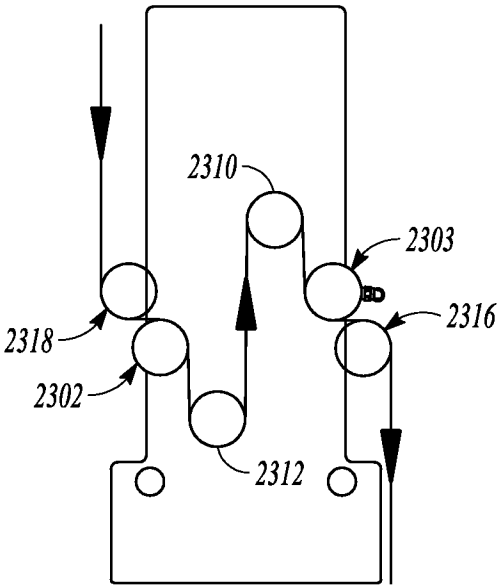
Figure 23C:
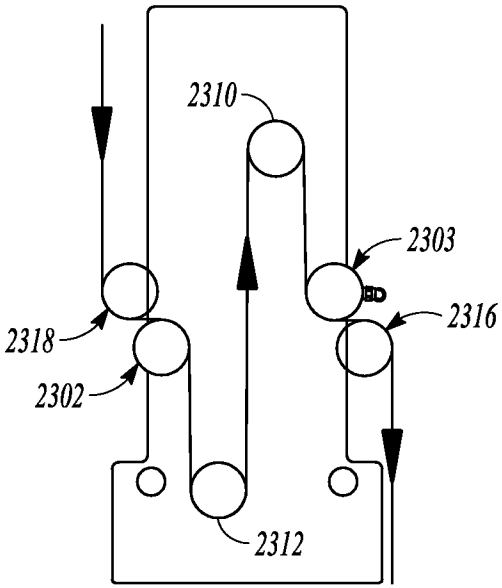

FIGS. 23A-23E further illustrate the eighth example of the semi-rotary accumulator of FIG. 15D, a web path, and motion of the movable idler shafts within the semi-rotary accumulator. The illustrated accumulator uses belts to drive the movable idler shafts. Other mechanisms for driving the movable idler shafts may be used (e.g. linear moors, ball screws, rack and pinion, mechanical cam, and the like). Also, those of ordinary skill in the art would understand that that the accumulator may be incorporated into a cantilevered design. The illustrated accumulator includes outboard-mounted idler shafts 2316 and 2318, idler shaft 2302, air bar 2303, and movable idler shafts 2310 and 2312. FIGS. 23C-23E illustrate web paths and further illustrate motion of the movable idlers shafts within the semi-rotary accumulator. These figures illustrate a schematic side view of the accumulator to illustrate the relative positions. The first and second movable idler shafts 2310 and 2312 move together in concert as their motion may be mechanically (e.g. belt, gear) or electronically (e.g. servo motor control) linked together. Simultaneous movement of the first movable idler shaft 2310 and the second movable idler shaft 2312 toward the positions illustrated in FIG. 23E decreases a length of the web path between the idler shaft 2302 and air bar 2303. The reverse motion of the first and second movable idlers shafts 2310 and 2312 back toward the positions illustrated in FIG. 23C increases the length of the web path between the idler shaft 2302 and air bar 2303. The idler shaft 2302 and air bar 2303 may have fixed axes to avoid introducing additional inertia into the web. However, a system may be designed to provide the complementary web length changes using non-fixed axes. Furthermore, the diameter of the idler shafts is not intended to limit the scope of the present subject matter.

The methods illustrated in this disclosure are not intended to be exclusive of other methods within the scope of the present subject matter. Those of ordinary skill in the art will understand, upon reading and comprehending this disclosure, other methods within the scope of the present subject matter. The above-identified embodiments, and portions of the illustrated embodiments, are not necessarily mutually exclusive. These embodiments, or portions thereof, can be combined. In various embodiments, the methods are implemented using a sequence of instructions which, when executed by one or more processors, cause the processor(s) to perform the respective method. In various embodiments, the methods are implemented as a set of instructions contained on a computer-accessible medium such as a magnetic medium, an electronic medium, or an optical medium.

The above detailed description is intended to be illustrative, and not restrictive. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method performed on a web fed through a first accumulator, past a station and through a second accumulator to sequentially move a portion of the web through the first accumulator, past the station, and through the second accumulator, the method comprising:

continuously moving the web at a constant line speed into the first accumulator and moving the web at the constant line speed from the second accumulator; and using the first and second accumulators to provide variable motion of the web past the station while the web continuously moves at the constant line speed into the first accumulator and at the constant line speed from the second accumulator.

2. The method of claim 1, wherein the station includes a part transfer station, the method including passing a second web past the part transfer station, and transferring parts of the web to the second web.

3. The method of claim 1, wherein the station includes a die cut station that includes a die cut roll, the method including rotating the die cut roll, wherein using the first and second accumulators to provide variable motion of the web past the station includes matching a speed of the web to the rotational speed of the die cut roll when performing a die cut on the web.

4. The method of claim 1, wherein using the first and second accumulators to provide variable motion of the web past the station includes using the first and second accumulators to intermittently stop the web.

5. The method of claim 1, wherein using the first and second accumulators to provide variable motion of the web past the station includes using the first and second accumulators to intermittently reverse motion of the web past the station.

6. The method of claim 1, wherein using the first and second accumulators to provide variable motion of the web past the station includes using the first and second accumulators to intermittently slow motion of the web past the station.

7. The method of claim 1, wherein using the first and second accumulators to provide variable motion of the web past the station includes controlling complementary motion of a first movable shaft in the first accumulator and a second movable shaft in the second accumulator, wherein the complementary motion includes increasing a length of the web in the first accumulator while simultaneously decreasing a length of the web in the second accumulator and further includes decreasing the length of the web in the first accumulator while simultaneously increasing the length of the web in the second accumulator.

8. The method of claim 7, wherein the complementary motion of the first movable shaft and the second movable shaft includes a linear motion of the first movable shaft and a linear motion of the second movable shaft.

9. The method of claim 7, wherein controlling complementary motion of the first movable shaft in the first accumulator and the second movable shaft in the second accumulator includes controlling operation of at least one motor linked to the first movable shaft and the second movable shaft.

10. The method of claim 9, wherein the at least one motor is electronically linked to the first movable shaft and the second movable shaft.

11. The method of claim 9, wherein the at least one motor is linked to the first movable shaft and the second movable shaft using linkage to a drive belt, linkage to a linear motor, linkage to a ball screw, linkage to a rack-and-pinion gearset or linkage to a mechanical cam.

12. The method of claim 9, controlling operation of the at least one motor linked to the first movable shaft and the second movable shaft includes implementing a programmed cam profile to control the variable motion.

13. A method performed on a web fed through a first accumulator, past a station and through a second accumulator to sequentially move a portion of the web through the first accumulator, past the station, and through the second accumulator, the method comprising:

continuously moving the web at a constant line speed into the first accumulator and moving the web at the constant line speed from the second accumulator; and using the first and second accumulators to provide variable motion of the web past the station while the web continuously moves at the constant line speed into the first accumulator and at the constant line speed from the second accumulator, wherein using the first and second accumulators to provide variable motion of the web past the station includes controlling operation of at least one motor linked a first movable shaft in the first accumulator and a second movable shaft in the second accumulator to provide complementary motion of the first movable shaft and the second movable shaft, wherein controlling operation of the at least one motor linked to the first movable shaft and the second movable shaft includes implementing a programmed cam profile to control the variable motion.

14. The method of claim 13, wherein implementing the programmed cam profile intermittently slows web motion past the station while the web continuously moves at the line speed into the first accumulator and from the second accumulator.

15. The method of claim 13, wherein implementing the programmed cam profile intermittently stops web motion past the station while the web continuously moves at the line speed into the first accumulator and from the second accumulator.

16. The method of claim 13, wherein implementing the programmed cam profile intermittently reverses web motion past the station while the web continuously moves at the line speed into the first accumulator and from the second accumulator.

17. A web processing system for use with a web running at a constant line speed, the system comprising:

a first accumulator configured to receive the web continuously moving at the constant line speed, a station configured to operate on the web after the web passes through the first accumulator, and a second accumulator configured to receive the web from the station and allow the web to continuously move away from the second accumulator at the constant line speed, wherein the first accumulator and the second accumulator are configured to cooperate to provide variable motion of the web past the station while the web continuously moves at the constant line speed into the first accumulator and at the constant line speed from the second accumulator.

18. The web processing system of claim 17, wherein the first accumulator includes a first movable shaft and the second accumulator includes a second movable shaft, wherein the first accumulator and the second accumulator are configured to cooperate to provide variable motion by controlling complementary motion of the first movable shaft and the second movable shaft, wherein the complementary motion includes increasing a length of the web in the first accumulator while simultaneously decreasing a length of the web in the second accumulator and further includes decreasing the length of the web in the first accumulator while simultaneously increasing the length of the web in the second accumulator.

19. The web processing system of claim 17, wherein the complementary motion of the first movable shaft and the second movable shaft includes a linear motion of the first movable shaft and a linear motion of the second movable shaft.

20. The web processing system of claim 17, further comprising at least one motor electronically or mechanically linked to the first movable shaft and the second movable shaft.

* * * * *